US005442812A

United States Patent [19]

Ishizaki et al.

[11] Patent Number: 5,442,812

[45] Date of Patent: Aug. 15, 1995

[54] ANTENNA SWITCHING APPARATUS FOR SELECTIVELY CONNECTING ANTENNA TO TRANSMITTER OR RECEIVER

[75] Inventors: Toshio Ishizaki, Kobe; Hideaki Nakakubo, Souraku; Hiroaki Kosugi, Hirakata; Kimio Aizawa, Ikoma; Shogo Iizuka, Yokohama , all of Japan

[73] Assignee: Matsushita Electric Industrial Co., Ltd., Osaka, Japan

[21] Appl. No.: 307,490

[22] Filed: Sep. 16, 1994

Related U.S. Application Data

[63] Continuation-in-part of Ser. No. 85,114, Jul. 2, 1993, abandoned.

[30] Foreign Application Priority Data

Jul. 8, 1992 [JP] Japan ..... 4-180849

[51] Int. Cl.[6] ..... H04B 1/46

[52] U.S. Cl. ..... 455/82; 333/104; 333/134; 455/83

[58] Field of Search ..... 333/101, 103, 104, 126, 333/134; 370/24, 30, 32; 455/78, 80, 82, 83

[56] References Cited

U.S. PATENT DOCUMENTS

| | | | |
|---|---|---|---|
| 4,055,807 | 10/1977 | Priniski et al. . | |
| 4,677,688 | 6/1987 | Yoshihara et al. | 455/82 |
| 5,023,866 | 6/1991 | DeMuro | 370/24 |
| 5,054,114 | 10/1991 | Erickson | 455/78 |
| 5,293,141 | 3/1994 | Kobayashi et al. | 333/134 X |

FOREIGN PATENT DOCUMENTS

| | | | |
|---|---|---|---|
| 174534 | 9/1985 | Japan | 455/83 |
| 7627 | 1/1990 | Japan | 455/83 |
| 3-32118 | 2/1991 | Japan . | |
| 1149043 | 6/1969 | United Kingdom . | |

OTHER PUBLICATIONS

"RF Front End Circuit Components Miniaturized Using Dielectric Resonators for Cellular Porable Telephones", Toshio Nishikawa, 2234 The Transactions of the Institute of Electronics, Information and Comm. Engineers E74 (1991) Jun., No. 6, Tokyo.

*Primary Examiner*—Paul Gensler

*Attorney, Agent, or Firm*—Wenderoth, Lind & Ponak

[57] ABSTRACT

An antenna switching apparatus for selectively connecting an antenna to either a transmitter for transmitting a transmitting signal having a transmitting frequency, or a receiver for receiving a receiving signal having a receiving frequency, which is different from the transmitting frequency, includes an antenna terminal electrically connected to the antenna; a transmitting terminal electrically connected to the transmitter, and a receiving terminal electrically connected to the receiver. A receiving filter for passing a receiving signal therethrough is electrically connected between the antenna terminal and the receiving terminal. An impedance adjusting element is electrically connected to an input end of the receiving filter, and has an element value such that an impedance when seen from the antenna terminal looking toward the receiving filter becomes substantially infinity at the transmitting frequency. Further, a switching device is electrically connected between the antenna terminal and the transmitting terminal, wherein it is turned on or off in response to a control signal.

25 Claims, 16 Drawing Sheets

ANTENNA SWITCHING APPARATUS FOR SELECTIVELY CONNECTING ANTENNA TO TRANSMITTER OR RECEIVER

This application is a Continuation-In-Part of now abandoned application, Ser. No. 08/085,114, filed Jul. 2, 1993.

BACKGROUND OF THE INVENTION

1. Field of the Invention

The present invention relates to an antenna switching apparatus for use in a radio transceiver such as a digital portable radio telephone or the like, and more particular, to an antenna switching apparatus comprising a means for selectively connecting an antenna to either a transmitter or a receiver.

2. Description of the Prior Art

FIG. 8 shows a conventional antenna switching apparatus 300.

Referring to FIG. 8, an anode electrode of a PIN diode 70 is electrically connected through a coupling capacitor 74 to a transmitting terminal 79 which is electrically connected to with a transmitter 101 having a transmitting frequency ft, and is also electrically connected through a high-frequency choke circuit comprising an inductor 78 and a capacitor 75 to ground. A cathode electrode of the PIN diode 70 is electrically connected through strip lines 73 and 83 and a coupling capacitor 77 to a receiving terminal 81 which is electrically connected to a receiver 102 having a receiving frequency fr, wherein each of the strip lines 73 and 83 has a length of $\lambda gt/4$ where $\lambda gt$ is the guide wavelength of the transmitting frequency ft.

Further, the cathode electrode of the PIN diode 70 is electrically connected through a coupling capacitor 76 to an antenna terminal 80 which is electrically connected to an antenna 100. A connection point between the two strip lines 73 and 83 is electrically connected through anode and cathode electrodes of a PIN diode 71 to ground, and a connection point between the strip line 83 and the coupling capacitor 77 is electrically connected through anode and cathode electrodes of a PIN diode 72 to ground. Furthermore, a connection point between the inductor 78 and the capacitor 75 is electrically connected to a bias terminal 82 which is electrically connected through a switch 200 to a battery 201 for supplying a positive direct-current bias voltage to the PIN diodes 70 to 72 for use as a switching device.

The operation of the antenna switching apparatus 300 constituted as described above will be described hereinafter.

First of all, when the switch 200 is turned off, namely, when a positive direct-current bias voltage is not applied to the bias terminal 82, the PIN diodes 70 to 72 are turned off, and then the impedance of each of the PIN diodes 70 to,72 becomes substantially infinity. Therefore, the impedance when seen from the antenna terminal 80 toward the transmitting terminal 79 becomes substantially infinity, and then the transmitting terminal 79 is electrically separated from the antenna terminal 80 while the antenna terminal 80 is electrically connected to the receiving terminal 81.

On the other hand, when the switch 200 is turned on, namely, when the positive direct-current bias voltage is supplied from the battery 201 through the switch 200 to the bias terminal 82, the PIN diodes 70 to 72 are turned on, and then the impedance of each of the PIN diodes 70 to 72 becomes substantially zero. Then, the connection point between the two strip lines 73 and 83 is electrically connected through the PIN diode 71 of a short-circuit to ground. Therefore, the phase at the antenna terminal 80 is shifted by a quarter of the guide wavelength of the transmitting frequency ft by the strip line 73, and then, it is grounded. This results in the impedance when seen from the antenna terminal 80 looking toward the receiving terminal 81 to become, substantially infinity. Accordingly, the receiving terminal 81 is separated at high-frequencies from the antenna terminal 80. On the other hand, since the PIN diode 20 is turned on, the transmitting terminal 79 is electrically connected to the antenna terminal 80.

In the above-mentioned conventional antenna switching apparatus 300, in order to obtain a higher isolation characteristic between the transmitting and receiving terminals 79 and 81 so that the transmitting frequency characteristic is not influenced by the frequency characteristic of the receiver 102, it is necessary to provide multi-stages of strip lines and PIN diodes between the antenna terminal 80 and the receiving terminal 81. Then, the length of the strip lines become longer, and the antenna switching apparatus becomes larger. Further, when providing multi-stages of strip lines and PIN diodes, the insertion loss between the antenna terminal 80 and the receiving terminal 81 increases. Therefore, in order to obtain a better receiving frequency characteristic, it is necessary to provide a large-sized receiving filter having a small insertion loss between the receiving terminal 81 and the antenna terminal 80, resulting in a large-sized antenna switching apparatus.

SUMMARY OF THE INVENTION

An object of the present invention is therefore to provide a small-sized antenna switching apparatus capable of selectively connecting an antenna to either transmitter or a receiver, said antenna switching apparatus having a simpler structure which includes a receiving filter for passing a receiving signal therethrough.

In order to achieve the aforementioned objective, according to one aspect of the present invention, an antenna switching apparatus is provided for selectively connecting an antenna to either a transmitter for transmitting a transmitting signal and having a transmitting frequency, or a receiver for receiving a receiving signal having a receiving frequency which is different from said transmitting frequency, comprising:

- an antenna terminal electrically connected to said antenna;
- a transmitting terminal electrically connected to said transmitter;
- a receiving terminal electrically connected to said receiver;
- a receiving filter, electrically connected between said antenna terminal and said receiving terminal, for passing a receiving signal therethrough;
- an impedance adjusting element electrically connected to an input end of said receiving filter, said impedance adjusting element having an element value such that an impedance when seen from said antenna terminal looking toward said receiving filter becomes substantially infinity at said transmitting frequency; and
- a switching device electrically connected between said antenna terminal and said transmitting terminal, said switching device being turned on or off in response to a control signal.

According to another aspect of the present invention, an antenna switching apparatus is provided for selectively connecting an antenna to either a transmitter for transmitting a transmitting signal having a transmitting frequency, or a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing a receiving signal therethrough;

an impedance adjusting element electrically connected to an input end of said receiving filter, said impedance adjusting element having an element value such that an impedance when seen from said antenna terminal looking toward said receiving filter becomes substantially infinity at said transmitting frequency;

a transmission line electrically connected between said antenna terminal and said transmitting terminal, said transmission line having a length equal to one quarter of the guide wavelength of the receiving frequency; and a switching device electrically connected between said transmitting terminal and ground, said switching device being turned on or off in response to a control signal, thereby switching over so that an impedance when seen from said antenna terminal looking toward said transmitting terminal becomes either substantially infinity or substantially zero, respectively.

In the above-mentioned antenna switching apparatus, said impedance adjusting element is an inductor electrically connected between the input end of said receiving filter and ground.

In the above-mentioned antenna switching apparatus, said impedance adjusting element is an inductor electrically connected between the input end of said receiving filter and said antenna terminal.

In the above-mentioned antenna switching apparatus, said impedance adjusting element is a transmission line connected between the input end of said receiving filter and said antenna terminal, said transmission line having a length such that an impedance when seen from said antenna terminal looking toward said receiving filter becomes substantially infinity at said transmitting frequency.

The above-mentioned antenna switching apparatus preferably further comprises a low-pass filter electrically connected between said antenna terminal and said receiving filter, said low-pass filter having a cut-off frequency equal to a value obtained by adding, the higher of said transmitting and receiving frequencies to a predetermined margin frequency.

The above-mentioned antenna switching apparatus preferably further comprises a low-pass filter electrically connected between said antenna terminal and said switching device, said low-pass filter having a cut-off frequency equal to a value obtained by adding said transmitting frequency to a predetermined margin frequency.

The above-mentioned antenna switching apparatus preferably further comprises a low-pass filter electrically connected between said transmitting terminal and said switching device, said low-pass filter having a cut-off frequency equal to a value obtained by adding said transmitting frequency to a predetermined margin frequency.

In the above-mentioned antenna switching apparatus, said switching device may be PIN diode.

In the above-mentioned antenna switching apparatus, said switching device may be a field effect transistor.

According to the present invention, a small-sized antenna switching apparatus can be provided which capable of selectively connecting an antenna to either transmitter or a receiver, said antenna switching apparatus having a simpler structure and a higher performance which includes a receiving filter for passing a receiving signal therethrough.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Preferred embodiments according to the present invention will be described below with reference to the attached drawings.

In the preferred embodiments, each of the antenna switching apparatuses of the preferred embodiments is provided for selectively connecting an antenna 100 to either a transmitter 101 having a transmitting frequency ft or a receiver 102 having a receiving frequency fr, wherein the transmitting frequency ft is not equal to the receiving frequency fr.

FIRST PREFERRED EMBODIMENT

Figure 1A:
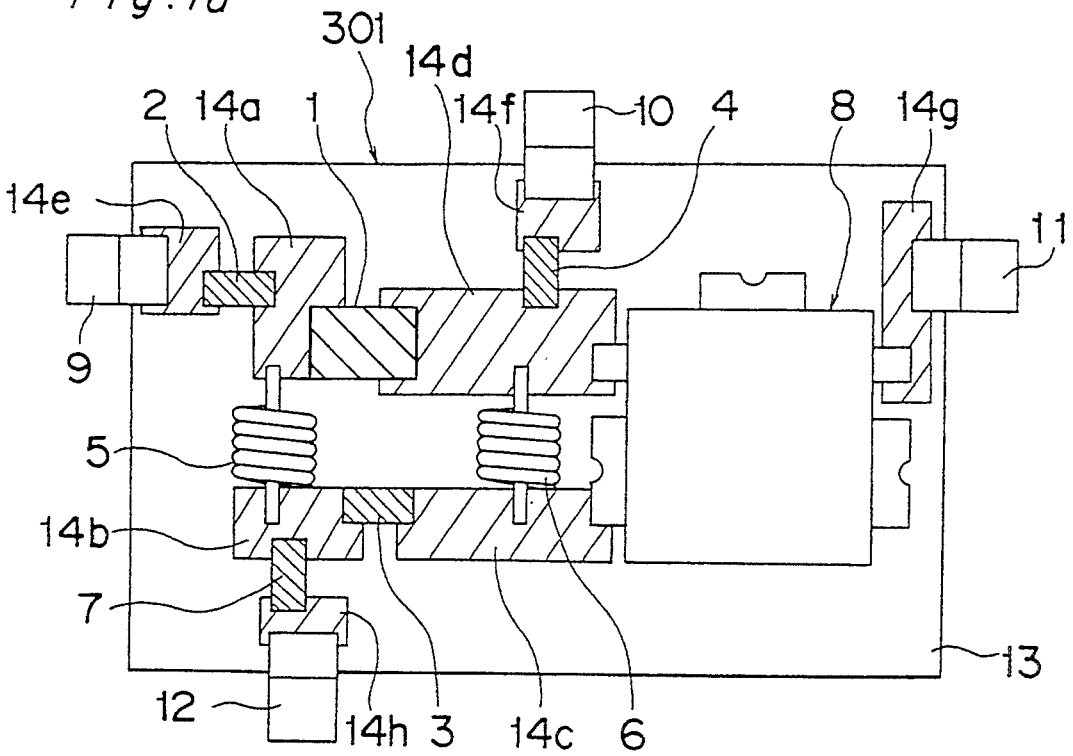
FIG. 1*a* is a top plan view of an antenna switching apparatus 301 of a first preferred embodiment according to the present invention.
Figure 8:
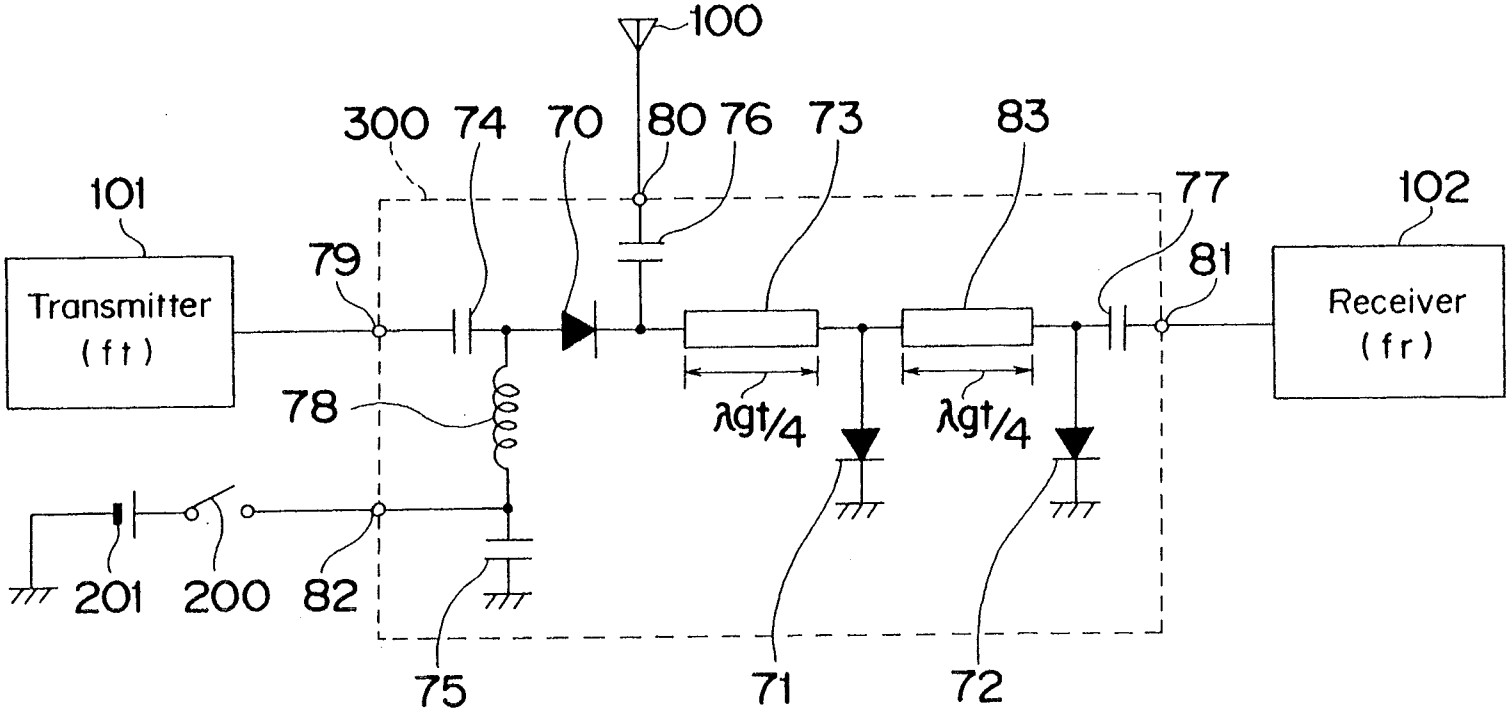
Fig.8 PRIOR ART
FIG. 8 is a circuit diagram of a conventional antenna switching apparatus 300.

FIG. 1*a* is a top plan view of an antenna switching apparatus 301 of a first preferred embodiment according to the present invention. In FIG. 1*a*, the same components as those shown in FIG. 8 are denoted by the same reference numerals as those shown in FIG. 8.

Referring to FIG. 1*a*, electrically conductive electrode patterns 14*a* to 14*h* are formed on a top surface of a dielectric substrate 13. An anode electrode of a PIN diode 1 for use as a switching device is electrically connected through the electrode pattern 14*a* to one end of a coupling chip capacitor 2 and to one end of an air-core inductor 5, and another end of the coupling chip capacitor 2 is electrically connected through the electrode pattern 14*e* to a transmitting terminal 9 which is electrically connected to the transmitter 101 for transmitting a transmitting signal having a transmitting frequency ft.

Figure 1B:
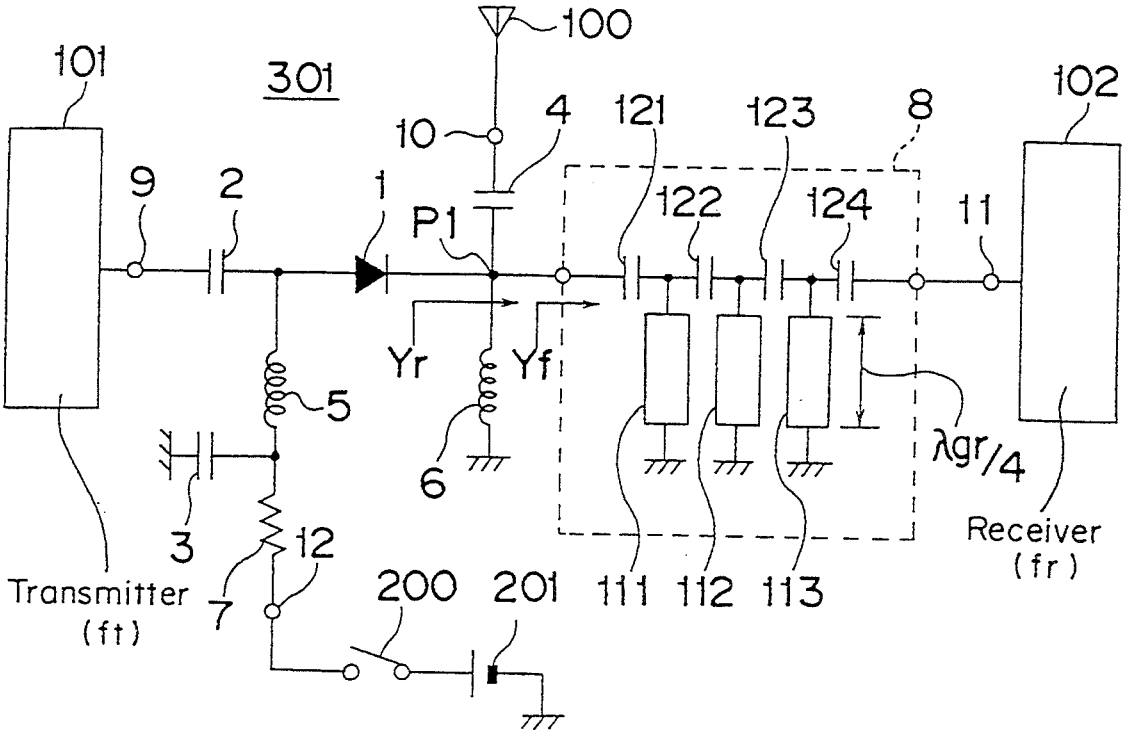
FIG. 1*b* is a circuit diagram of the antenna switching apparatus 301 shown in FIG. 1*a*.

Another end of the air-core inductor 5 is electrically connected through the electrode pattern 14*b* to one end of a chip capacitor 3 and to one end of a chip resistor 7, wherein another end of the chip capacitor 3 is electrically connected through the electrode pattern 14*c* to ground, and another end of the chip resistor 7 is electrically connected through the electrode pattern 14*h* to a bias terminal 12 which is electrically connected through a switch 200 to a positive electrode of a battery 201 having a negative electrode electrically connected to ground as shown in FIG. 1*b*.

Further, a cathode electrode of the PIN diode 1 is electrically through the electrode pattern 14*d* with not only one respective end of a coupling chip capacitor 4 and an air-core inductor 6 but also to an input end of a plane type dielectric receiving band-pass filter 8 having a pass-band for passing therethrough a receiving signal having the receiving frequency fr. Another end of the air-core inductor 6 is electrically connected through the electrode pattern 14*c* to ground. Another end of the coupling chip capacitor 4 is electrically connected through the electrode pattern 14*f* to an antenna terminal 10 which is electrically connected to the antenna 100. Furthermore, an output end of the receiving band-pass filter 8 is electrically connected through 14*g* to the receiving terminal 11 which is electrically connected to the receiver 102 for receiving a receiving signal having a receiving frequency fr.

As shown in FIG. 1*b* in the receiving band-pass filter 8, four capacitors 121 to 124 are electrically connected in series to each other between both the input and output ends thereof. A connection point between the two capacitors 121 and 122 is electrically connected to ground through a strip line 111 having a length of λgr/4 , a connection point between the two capacitors 122 and 123 is electrically connected to ground through a strip line 112 having a length of λgr/4 with ground, and a connection point between the two capacitors 123 and 124 is electrically connected to ground through a strip line 113 having a length of λgr/4 with ground, wherein λgr is a guide wavelength of the receiving frequency fr.

In the antenna switching apparatus 301, when the admittance Yf when seen from the input end of the receiving band-pass filter 8 looking toward the output end thereof is represented by $Yf=G+jB$ where $G\approx 0$ at the transmitting frequency ft, the inductance L of the air-core inductor 6 is predetermined so as to satisfy the following equation at the transmitting frequency ft:

$$B=1/(\omega L) \quad (1),$$

where $\omega=2\pi(ft)$.

Therefore, the admittance Yr when-seen from the connection point P1 to the PIN diode 1, the coupling capacitor 4 and the air-core inductor 6 looking toward the receiving band-pass filter 8 is represented at the transmitting frequency ft by the following equation:

$$\begin{aligned} Yr &= 1/j\omega L + Yf \\ &= 1/j\omega L + G + jB. \end{aligned} \quad (2)$$

Substituting the equation (1) into the equation (2) obtains the following equation:

$$Yr=G\approx 0 \text{ at the transmitting frequency ft} \quad (3).$$

FIG. 1*b* is a circuit diagram of the antenna switching apparatus 301 shown in FIG. 1*a*. The operation of the antenna switching apparatus 301 will be described in detail hereinafter with reference to FIG. 1*b*.

First of all, when the switch 200 is turned off, namely, when a positive direct-current bias voltage is not supplied to the bias terminal 12, the PIN diode 1 is turned off, and the impedance of the PIN diode 1 becomes substantially infinity. Therefore, the impedance when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr with the receiving terminal 11.

On the other hand, when the switch 200 is turned on, namely, when the positive direct-current bias voltage is supplied from the battery 201 through the switch 200 to the bias terminal 12, the PIN diode 1 is turned on, and the impedance of the PIN diode 1 becomes substantially zero. As is apparent from the equation (3), since the air-core inductor 6 is electrically connected to the connection point P1, the admittance Yr when seen from the connection point P1 or the antenna terminal 10 looking toward the receiving band-pass filter 8 becomes substantially zero at the transmitting frequency ft, namely, the impedance when seen from the connection point P1 toward the receiving band-pass filter 8 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the PIN diode 1 is turned on.

According to the first preferred embodiment, since the impedance when seen from the antenna terminal 10, looking toward the receiving band-pass filter 8 becomes substantially infinity at the transmitting frequency ft, the transmitting frequency characteristic is not influenced by the frequency characteristic of the receiver 102, and it is not necessary to provide any multi-stage band-pass filter, resulting in not only less insertion loss between the antenna terminal 10 and the receiving terminal 11 but also an improvement in the isolation characteristic between the transmitting and receiving terminals 9 and 11, as compared with the conventional antenna switching apparatus 300 shown in FIG. 8. Further, as is apparent from FIGS. 1*a* and 1*b*, the smaller-sized antenna switching apparatus 301 having a simpler circuit can be easily obtained as compared with the conventional antenna switching apparatus 300.

In the first preferred embodiment, the PIN diode 1 is used as a switching device; however, the present invention is not limited to this. For example, an FET (Field Effect Transistor) may be used.

SECOND PREFERRED EMBODIMENT

Figure 2A:
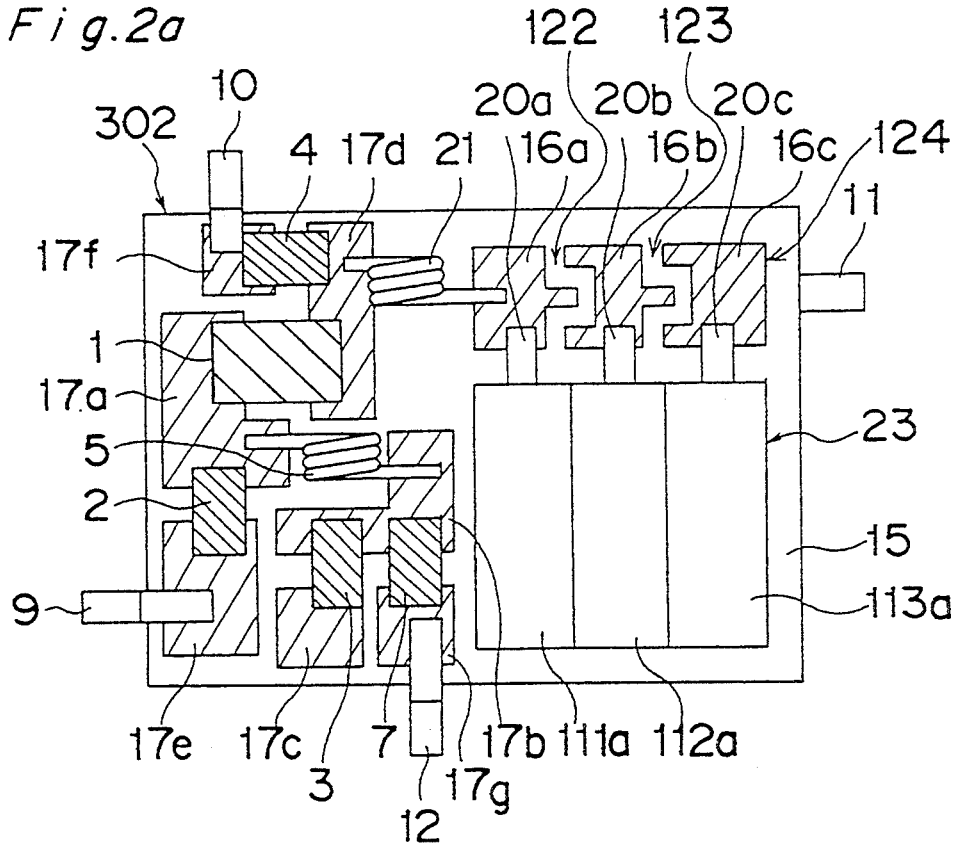
FIG. 2*a* is a top plan view of an antenna switching apparatus 302 of a second preferred embodiment according to the present invention.
Figure 2B:
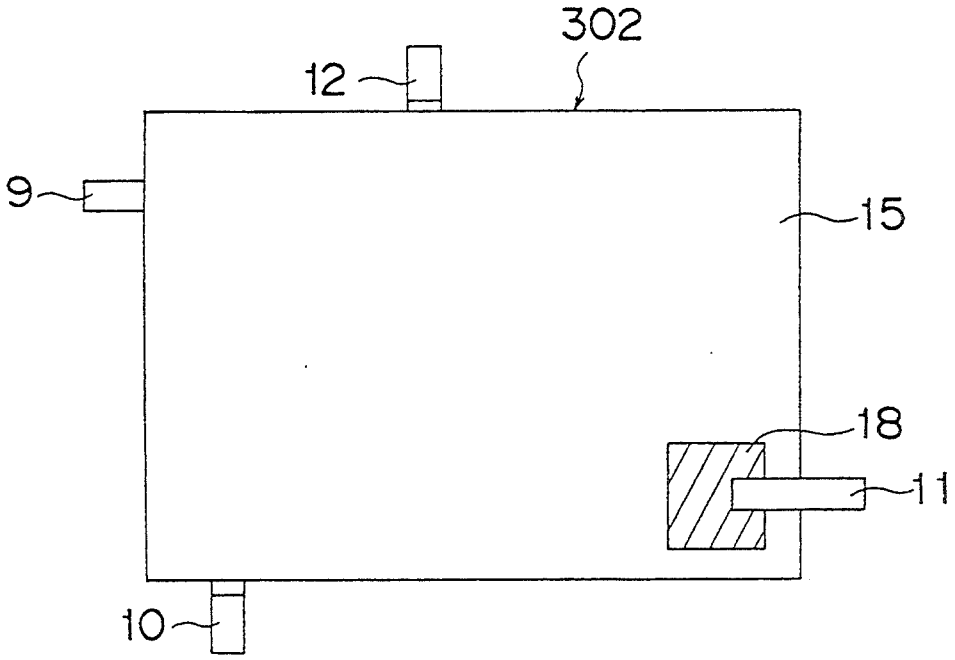
FIG. 2*b* is a bottom plan view of an antenna switching apparatus 302 shown in FIG. 2*a*.

FIG. 2*a* is a top plan view of an antenna switching apparatus 302 of a second preferred embodiment according to the present invention, and FIG. 2*b* is a bottom plan view of an antenna switching apparatus 302 shown in FIG. 2*a*. In FIGS. 2*a* and 2*b*, the same components as those shown in FIGS. 1*a*, 1*b* and 8 are denoted by the same numerals as those shown in FIGS. 1*a*, 1*b* and 8.

Referring to FIG. 2*a*, electrically conductive electrode patterns 16*a* to 16*c* and 17*a* to 17*g* are formed on a top surface of a dielectric substrate 15, and an electrically conductive electrode pattern 18 is formed on a bottom surface of the dielectric substrate 15. The components 1, 2, 3, 5 and 7 are electrically connected through the electrode patterns 17*a* to 17*g* to the terminals 9, 10 and 12, in a manner similar to that of the first preferred embodiment.

Figure 2C:
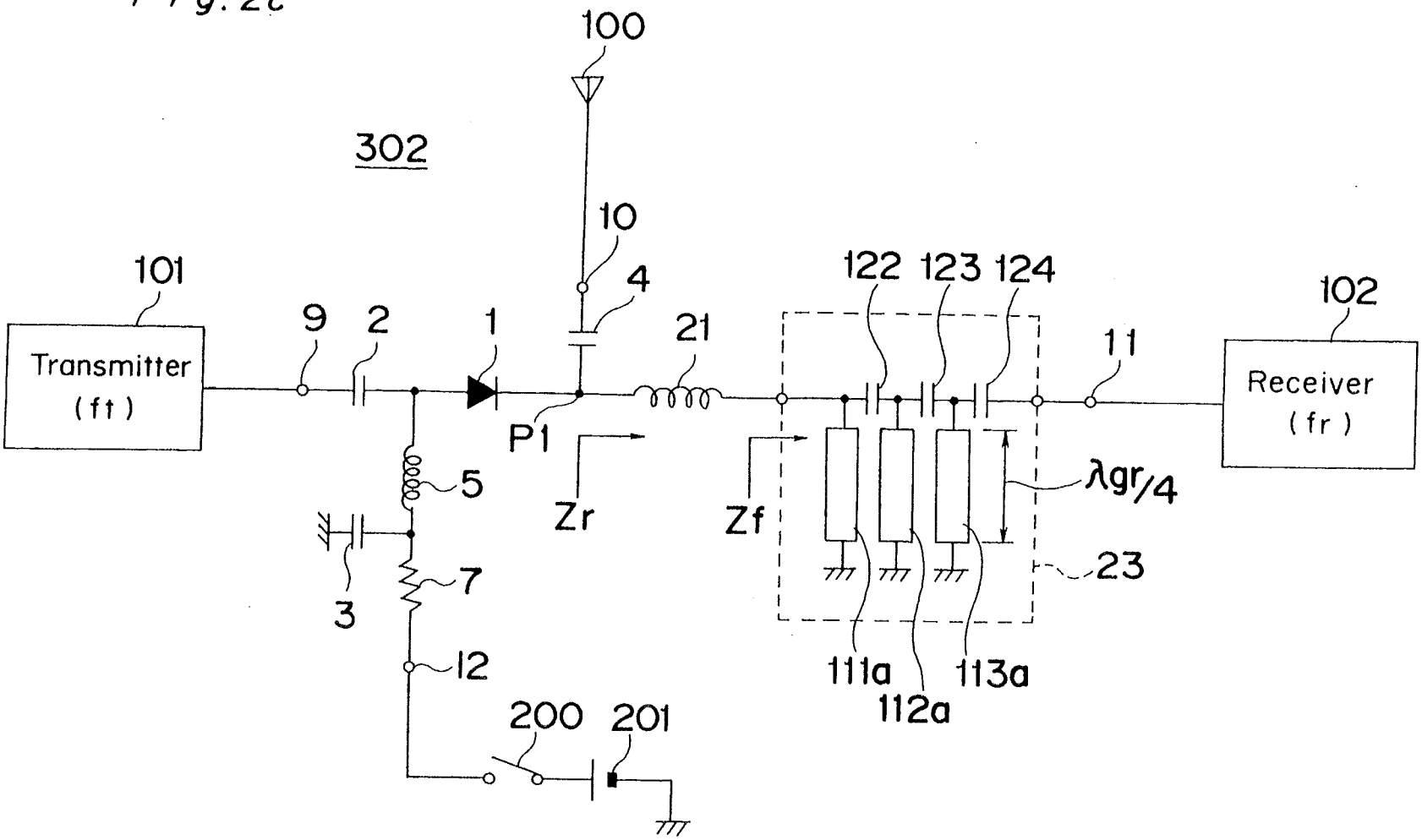
FIG. 2*c* is a circuit diagram of the antenna switching apparatus 302 shown in FIGS. 2*a* and 2*b*.

FIG. 2*c* is a circuit diagram of the antenna switching apparatus 302 shown in FIGS. 2*a* and 2*b*.

As is apparent from comparison between the first and second preferred embodiments respectively shown in FIGS. 1*b* and 2*c*, there are further provided (a) an air-core inductor 21 and (b) a dielectric coaxial receiving band-pass filter 23 in the second preferred embodiment, which will be described in detail hereinafter.

Referring to FIG. 2*a*, one end of the air-core inductor 21 is electrically connected through the electrode pattern 17*d* to one end of the coupling capacitor 4, and another end of the air-core inductor 21 is electrically connected through the electrode pattern 16*a* to an input end 20*a* of the receiving band-pass filter 23 which also has other input ends 20*b* and 20*c*.

The receiving band-pass filter 23 is provided between the air-core inductor 21 and the receiving terminal 11 for passing therethrough the receiving signal having the receiving frequency fr, and comprises not only three capacitors 122 to 124 connected in series to each other but also three dielectric coaxial resonators 111*a*, 112*a* and 113*a* each having a length of λgr/4.

A space on the dielectric substrate 15 formed between the electrode patterns 16*a* and 16*b* constitutes the capacitor 122, and a space on the dielectric substrate 15 formed between the electrode patterns 16*b* and 16*c* constitutes the capacitor 123. Further, the dielectric substrate 15 provided between the electrode patterns 16*c* and 18 constitutes the capacitor 124. Thus, there are electrically connected three capacitors 122 to 124 between both the input and output ends of the receiving band-pass filter 23.

The electrode pattern 16*a* of the input end of the receiving band-pass filter 23 is electrically connected through the dielectric coaxial resonator 111*a* to ground; the electrode pattern 16*b* of the connection point between the two capacitors 122 and 123 is electrically connected through the dielectric coaxial resonator 112*a* to ground, and the electrode pattern 16*c* of the connection point between the two capacitors 123 and 124 is electrically connected through the dielectric coaxial resonator 113*a* to ground.

In the antenna switching apparatus 302, when the impedance Zf when seen from the input end of the receiving band-pass filter 23 looking toward the output end thereof is represented by $Zf=R+jX$ where $R\approx\infty$ at the transmitting frequency ft, the inductance L of the air-core inductor 21 is predetermined so as to satisfy the following equation at the transmitting frequency ft:

$$X=-\omega L \tag{4}$$

Therefore, the impedance Zr when seen from the connection point P1 of the PIN diode 1, the coupling capacitor 4 and the air-core inductor 21 looking toward the receiving band-pass filter 23 is represented at the transmitting frequency ft by the following equation:

$$\begin{aligned} Zr &= j\omega L + Zf \\ &= j\omega L + R + jX. \end{aligned} \tag{5}$$

Substituting the equation (4) into the equation (5) obtains the following equation:

$$Zr=R\approx\infty \text{ at the transmitting frequency ft} \tag{6}$$

An action of the antenna switching apparatus 302 will be described in detail hereinafter with reference to FIG. 2*c*.

First of all, when the switch 200 is turned off, namely, when a positive direct-current bias voltage is not supplied to the bias terminal 12, the PIN diode 1 is turned off, and then the impedance of the PIN diode 1 becomes substantially infinity. Therefore, the impedance when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr to the receiving terminal 11.

On the other hand, when the switch 200 is turned on, namely, when the positive direct-current bias voltage is supplied from the battery 201 through the switch 200 to the bias terminal 12, the PIN diode 1 is turned on, and the impedance of the PIN diode 1 becomes substantially zero. As is apparent from the equation (6), since the air-core inductor 21 is electrically connected as an input coupling component with the connection point P1, the impedance Zr when seen from the connection point P1 or the antenna terminal 10 looking toward the receiving band-pass filter 23 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the PIN diode 1 is turned on.

The antenna switching apparatus 302 according to the second preferred embodiment has the effects similar to those of the first preferred embodiment. In addition to these effects, since the bias current flows from the air-core inductor 21 through the dielectric coaxial resonator 111*a* to ground, it is not necessary to provide one capacitor 121 of the receiving band-pass filter 8 as compared with the first preferred embodiment. This results in a smaller-sized antenna switching apparatus 302 having a simpler circuit that can be easily obtained as compared with the antenna switching apparatus 300 and 301.

THIRD PREFERRED EMBODIMENT

Figure 3A:
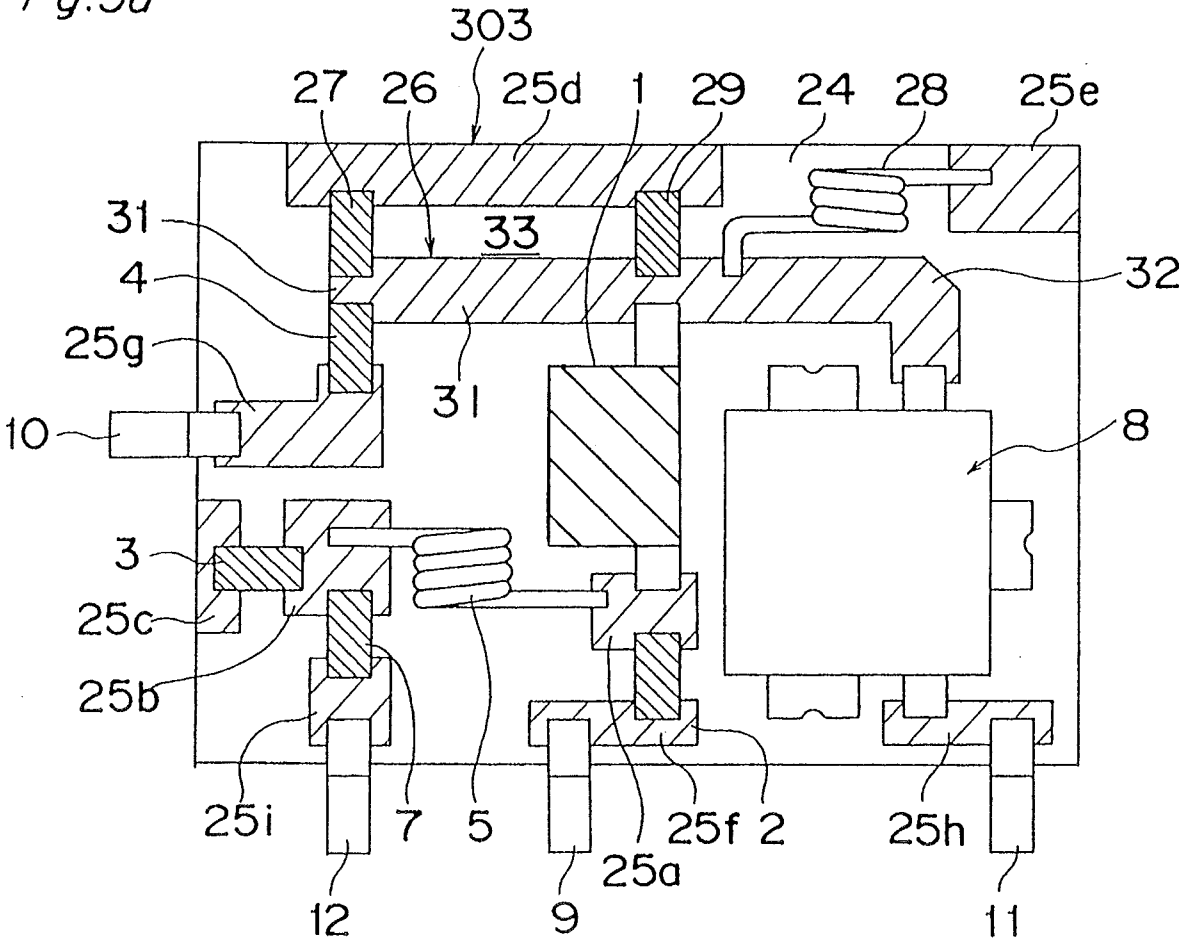
FIG. 3*a* is a top plan view of an antenna switching apparatus 303 of a third preferred embodiment according to the present invention.

FIG. 3*a* is a top plan view of an antenna switching apparatus 303 of a third preferred embodiment according to the present invention. In FIG. 3*a*, the same components as those shown in FIGS. 1*a*, 1*b*, 2*a*, 2*b*, 2*c* and 8 are denoted by the same numerals as those shown in FIGS. 1*a*, 1*b*, 2*a*, 2*b*, 2*c* and 8.

Referring to FIG. 3*a*, electrically conductive electrode patterns 25*a* to 25*i* and an electrically conductive electrode pattern 26 for use as microstrip lines 31 and 32 connected in series are formed on a top surface of a dielectric substrate 24, and a grounded electrically conductive electrode pattern (not shown) is formed on the entire area of the bottom surface of the dielectric substrate 24. The components 1, 2, 3, 5 and 7 are electrically connected through the electrode patterns 25*a* to 25*c*, 25*i* and 25*f* to the terminals 9, 10 and 12, in a manner similar to that of the first preferred embodiment.

Figure 3B:
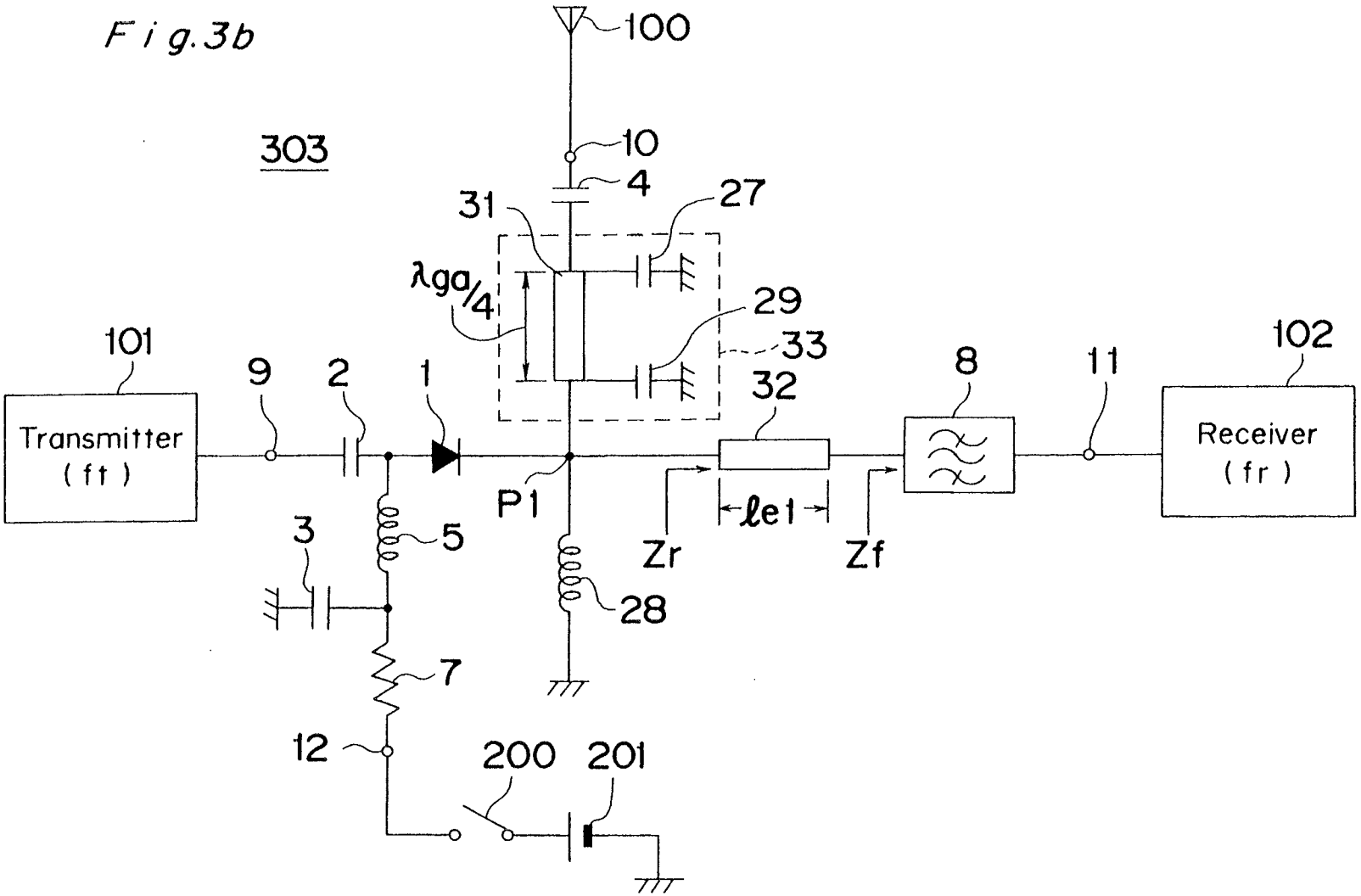
FIG. 3*b* is a circuit diagram of the antenna switching apparatus 303 shown in FIG. 3*a*.

FIG. 3*b* is a circuit diagram of the antenna switching apparatus 303 shown in FIG. 3*a*.

As is apparent from a comparison between the first and third preferred embodiments respectively shown in FIGS. 1*b* and 3*b*, there are further provided (a) an air-core inductor 28 for allowing a bias current to flow therethrough instead of the air-core inductor 6 of the first preferred embodiment;
(b) a microstrip line 32 having a length le1; and
(c) a low-pass filter 33 comprising a microstrip line 31 and two capacitors 27 and 29, which will be described in detail hereinafter.

Referring to FIG. 3*a*, the microstrip lines 31 and 32 connected in series are constituted by the electrode pattern 26. One end of the air-core inductor 28 is electrically connected through the middle point on the electrode pattern 26 corresponding to the connection point P1 to the cathode electrode of the PIN diode 1 and one end of the low-pass filter 33, while another end of the air-core inductor 28 is electrically connected through the electrode pattern 25*e* to ground. Another end of the low-pass filter 33 is electrically connected through one end of the electrode pattern 26 to one end of the capacitor 4. Another end of the microstrip line 32 is electrically connected to the input end of the receiving band-pass filter 8.

In the low-pass filter 33, the microstrip line 31 has a length of $\lambda ga/4$ where $\lambda ga$ is the guide wavelength of a cut-off frequency fc of the low-pass filter 33 equal to a value obtained by adding the higher of the transmitting and receiving frequencies ft and fr to a predetermined margin frequency.

In the antenna switching apparatus 303, when the impedance Zf when seen from the input end of the receiving band-pass filter 8 looking toward the output end thereof is represented by $Zf=R+jX$ where $R \approx \infty$ at the transmitting frequency ft, the length le1 of the microstrip line 32 is predetermined so that the impedance Zr when seen from the connection point P1 looking toward the receiving band-pass filter 8 becomes substantially infinity by rotating the phase at the connection point P1 by the following angle $\theta$ at the transmitting frequency ft about the center of the Smith chart:

$$\theta=\tan^{-1}(X/R) \quad (7).$$

An action of the antenna switching apparatus 303 will be described in detail hereinafter with reference to FIG. 3*b*.

First of all, when the switch 200 is turned off, namely, when a positive direct-current bias voltage is not supplied to the bias terminal 12, the PIN diode 1 is turned off, and then the impedance of the PIN diode 1 becomes substantially infinity. Therefore, the impedance Zt when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr to the receiving terminal 11.

On the other hand, when the switch 200 is turned on, namely, when the positive direct-current bias voltage is supplied from the battery 201 through the switch 200 to the bias terminal 12, the PIN diode 1 is turned on, and the impedance of the PIN diode 1 becomes substantially zero. As described above, since the microstrip line 32 is electrically connected as an input coupling component between the connection point P1 and the input end of the receiving band-pass filter 8, the impedance Zr when seen from the connection point P1 looking toward the receiving band-pass filter 8 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the PIN diode 1 is turned on.

The antenna switching apparatus 303 according to the third preferred embodiment has the effects similar to those of the first preferred embodiment. In addition to these effects, since the low-pass filter 33 is provided between the coupling capacitor 4 and the connection point P1, unnecessary high-order higher harmonics having frequencies higher than the cut-off frequency fc of the low-pass filter 33 can be sufficiently suppressed upon transmitting and receiving, resulting in improvement in the high-order higher harmonic characteristic in both transmitting and receiving.

In the third preferred embodiment, the microstrip lines 31 and 32 are used; however, the present invention is not limited to this. Transmission lines such as strip lines, coplanar lines or the like may be used instead of the microstrip lines 31 and 32.

FOURTH PREFERRED EMBODIMENT

Figure 4A:
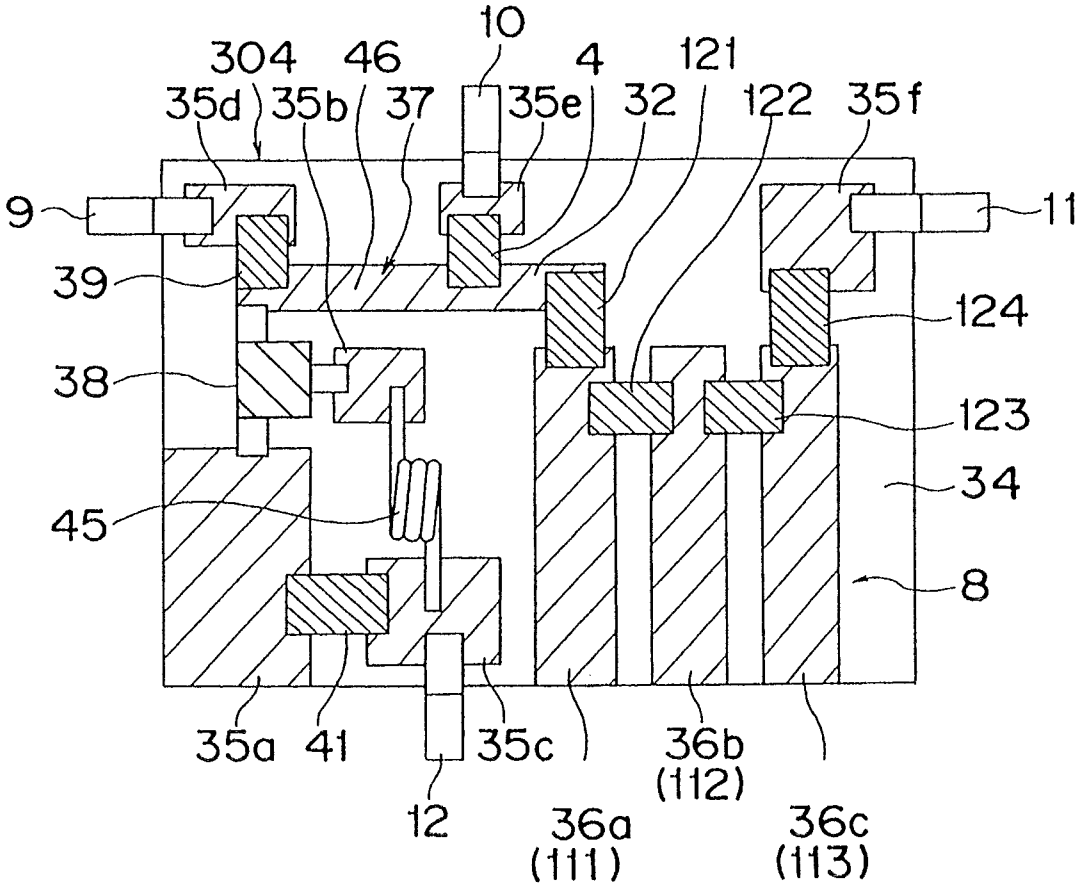
FIG. 4*a* is a top plan view of an antenna switching apparatus 304 of a fourth preferred embodiment according to the present invention.

FIG. 4*a* is a top plan view of an antenna switching apparatus 304 of a fourth preferred embodiment according to the present invention. In FIG. 4*a*, the same components as those shown in FIGS. 1*a*, 1*b*, 2*a*, 2*b*, 2*c*, 3*a*, 3*b* and 8 are denoted by the same reference numerals as those shown in FIGS. 1*a*, 1*b*, 2*a*, 2*b*, 2*c*, 3*a*, 3*b* and 8.

Referring to FIG. 4*a*, not only electrically conductive electrode patterns 35*a* to 35*f* and 37 but also electrically conductive electrode patterns 36*a*, 36*b* and 36*c* respectively for use as microstrip lines 111, 112 and 113 each acting as microstrip line resonator are formed on a top surface of a dielectric substrate 34. Also, an electrically conductive grounded electrode pattern (not shown) is formed on the entire area of the bottom surface of the dielectric substrate 34. The components 4, 8 and 32 are electrically connected to the terminals 10 and 11, in a manner similar to that of the third preferred embodiment.

Figure 4B:
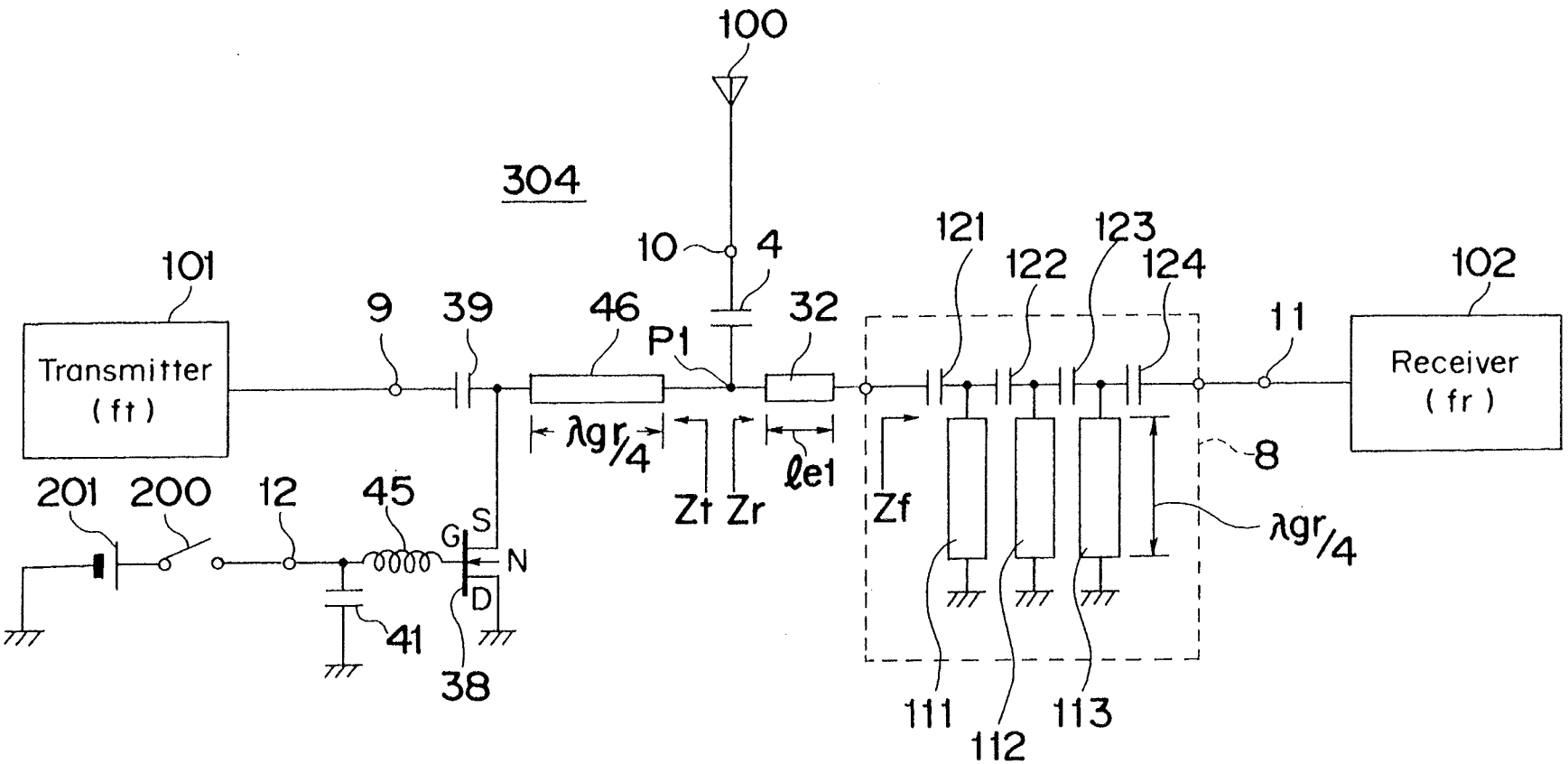
FIG. 4*b* is a circuit diagram of the antenna switching apparatus 304 shown in FIG. 4*a*.

FIG. 4*b* is a circuit diagram of the antenna switching apparatus 304 shown in FIG. 4*a*. As is apparent from comparison between the third and fourth preferred embodiments respectively shown in FIGS. 3*b* and 4*b*, there are further provided (a) a microstrip line 46 having a length of λgr/4 where λgr is the guide wavelength of the receiving frequency fr;

(b) a coupling capacitor 39;

(c) an N channel FET 38 for use as a switching device;

(d) an air-core inductor 45 for a high-frequency choke circuit; and (e) a capacitor 41 for the high-frequency choke circuit, which will be described in detail hereinafter.

Referring to FIG. 4*a*, the microstrip lines 46 and 32 connected in series are constituted by the electrode pattern 37. The middle point of the electrode pattern 37 located at the connection point P1 is electrically connected through the microstrip line 46 and the coupling capacitor 39 to the transmitting terminal 9, and a connection point located at one end of the electrode pattern 37 between the microstrip line 46 and the capacitor 39 is electrically connected to a source electrode of the FET 38. A drain electrode of the FET 38 is electrically connected through the electrode pattern 35*a* to ground, and a gate electrode thereof is electrically connected through the electrode pattern 35*b* and the air-core inductor 45 to the bias terminal 12, which is electrically connected through the capacitor 41 and the electrode pattern 35*a* with ground.

The operation of the antenna switching apparatus 304 will be described in detail hereinafter with reference to FIG. 4*b*.

First of all, when the switch 200 is turned on, namely, when a positive direct-current bias voltage is supplied to the bias terminal 12, the FET 38 is turned on, and then the impedance between the source and drain electrodes of the FET 38 becomes substantially zero, and the one end of the microstrip line 46 on the side of the capacitor 39 is electrically connected through the FET 38 to a short-circuit to ground. This results in the phase at another end of the microstrip line 46 being shifted by λgr/4 by the microstrip line 46, and thereafter electrically connected through the FET 38 with ground. Therefore, the impedance Zt when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr to the receiving terminal 11.

On the other hand, when the switch 200 is turned off, namely, when the positive direct-current bias voltage is not supplied from the battery 201 through the switch 200 to the bias terminal 12, the FET 38 is turned off, and the impedance between the source and drain electrodes of the FET 38 becomes substantially infinity. Further, as described above, since the microstrip line 32 is electrically connected as an input coupling component to the connection point P1, the impedance Zr when seen from the connection point P1 or the antenna terminal 10 looking toward the receiving band-pass filter 8 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the FET 38 is turned off.

The antenna switching apparatus 304 according to the fourth preferred embodiment has the effects similar to those of the third preferred embodiment.

In the fourth preferred embodiment, the microstrip lines 32 and 46 are used; however, the present invention is not limited to this. Transmission lines such as strip lines, coplanar lines or the like may be used instead of the microstrip lines 32 and 46.

Figure 4C:
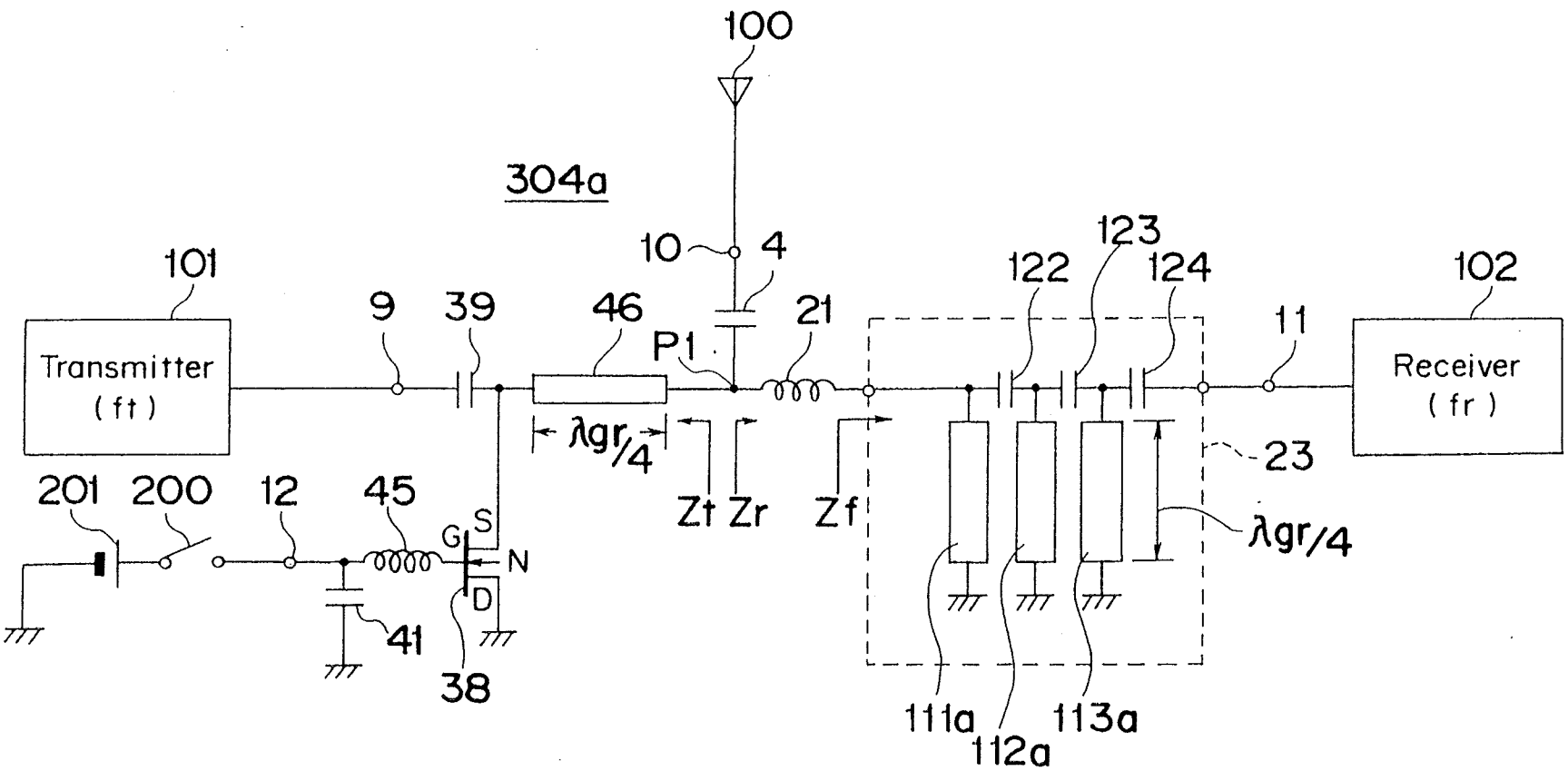
FIG. 4*c* is a circuit diagram of an antenna switching apparatus 304*a* of a first modification of the fourth preferred embodiment according to the present invention.

Further, as shown in FIG. 4*c* showing an antenna switching apparatus 304*a* of a first modification of the fourth preferred embodiment according to the present invention, as compared with the fourth preferred embodiment shown in FIG. 4*b*, the air-core inductor 21 and the receiving band-pass filter 23 of the second preferred embodiment, may be provided respectively, instead of the microstrip line 32 and the receiving band-pass filter 8.

Figure 4D:
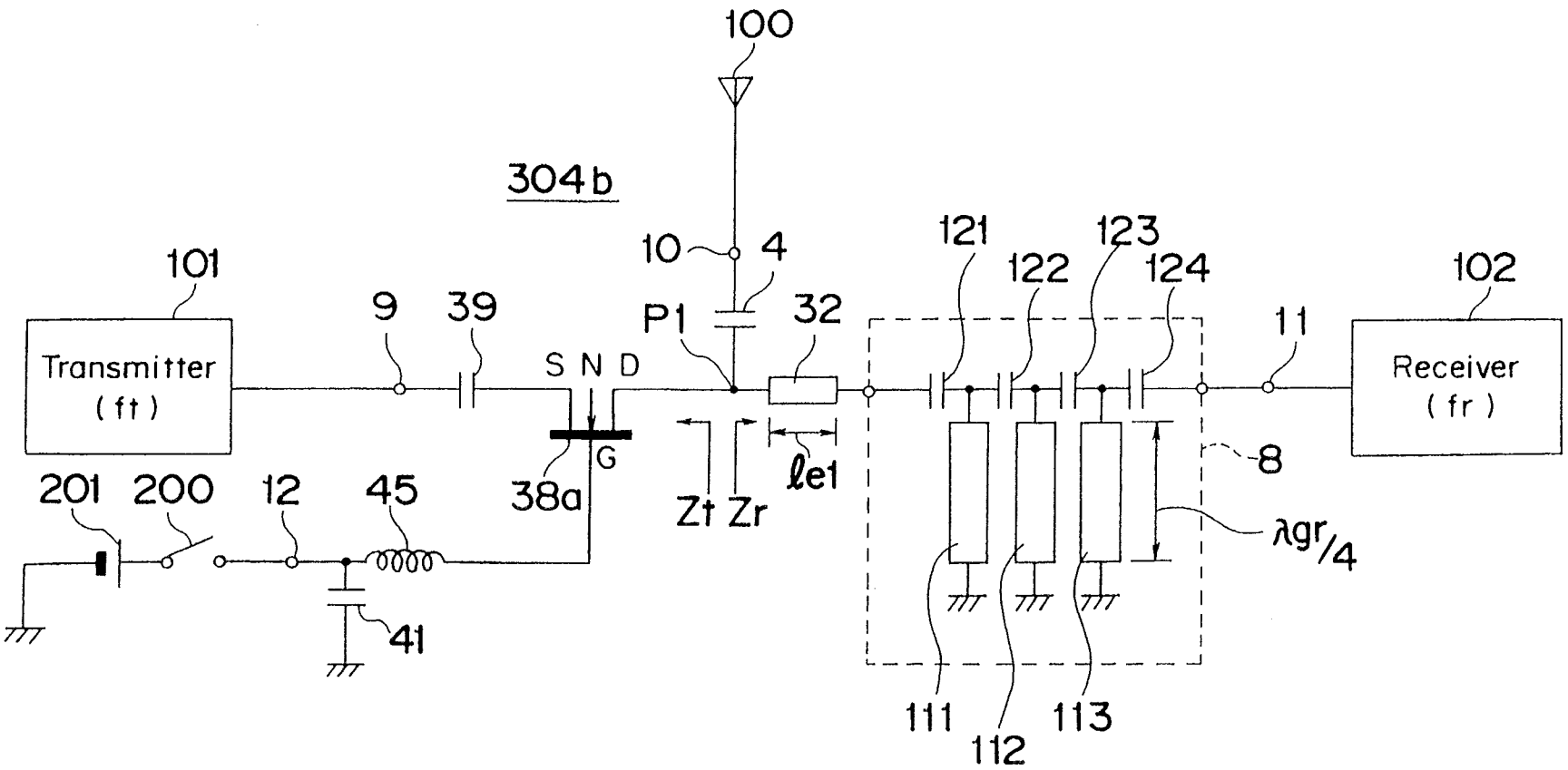
FIG. 4*d* is a circuit diagram of an antenna switching apparatus 304*b* of a second modification of the fourth preferred embodiment according to the present invention.

Further, as shown in FIG. 4*d* showing an antenna switching apparatus 304*b* of a second modification of the fourth preferred embodiment according to the present invention, as compared with the fourth preferred embodiment shown in FIG. 4*b*, an N channel FET 38*a* may be provided for use as a switching device instead of the microstrip line 46. In this case, a gate electrode of the FET 38*a* is electrically connected through the air-core inductor 45 to the bias terminal 12, which is electrically connected through the capacitor 41 to ground. In the second modification, an electrical connection between the antenna terminal 10 and the transmitting terminal 9 is switched over by the FET 38*a*.

Figure 4E:
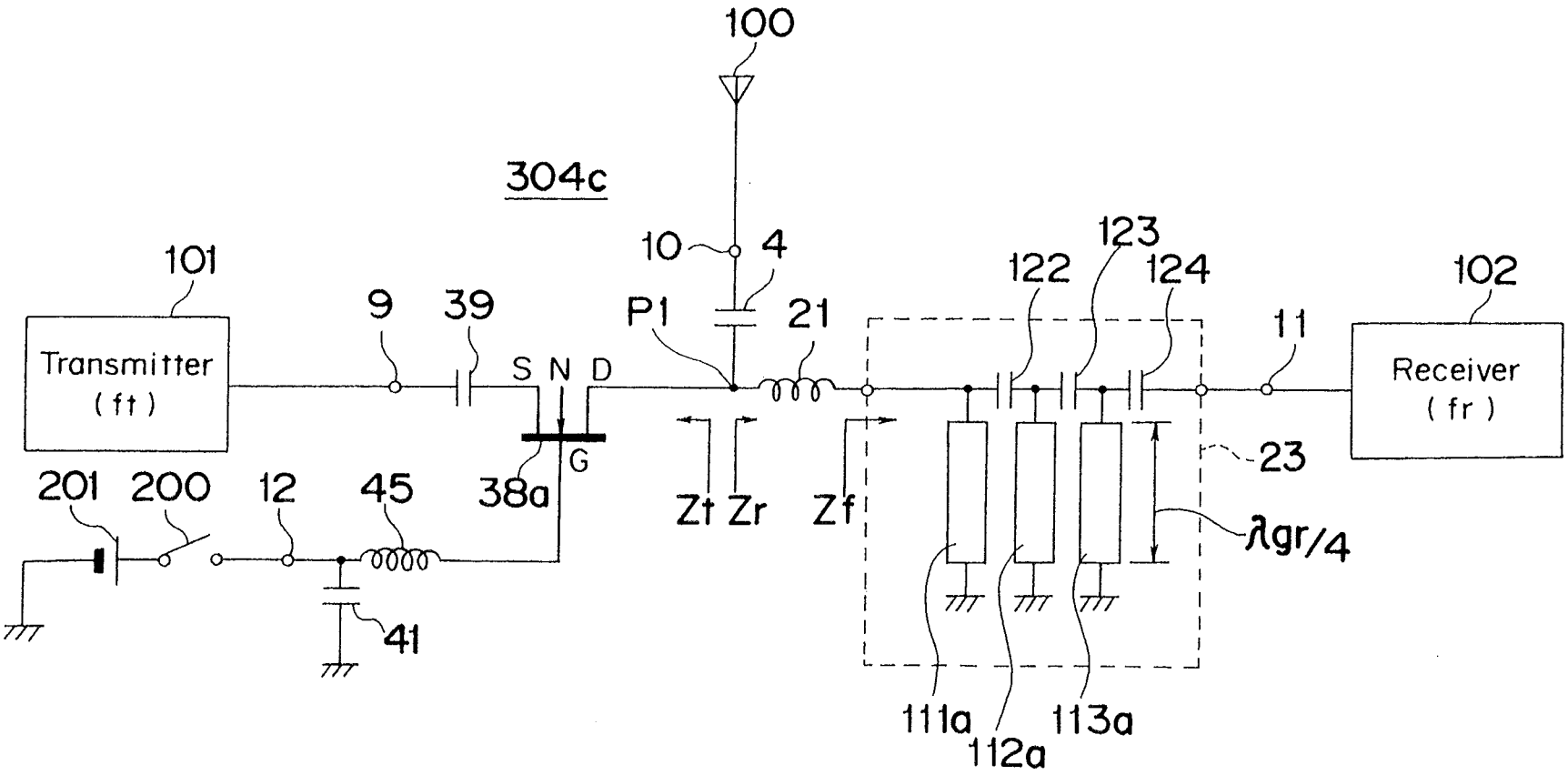
FIG. 4*e* is a circuit diagram of an antenna switching apparatus 304*c* of a third modification of the fourth preferred embodiment according to the present invention.

Furthermore, as shown in FIG. 4*e* showing an antenna switching apparatus 304*c* of a third modification of the fourth preferred embodiment according to the present invention, in the above-mentioned second modification, the air-core inductor 21 and the receiving band-pass filter 23 of the second preferred embodiment, may be provided respectively, instead of the microstrip line 32 and the receiving band-pass filter 8.

FIFTH PREFERRED EMBODIMENT

Figure 5A:
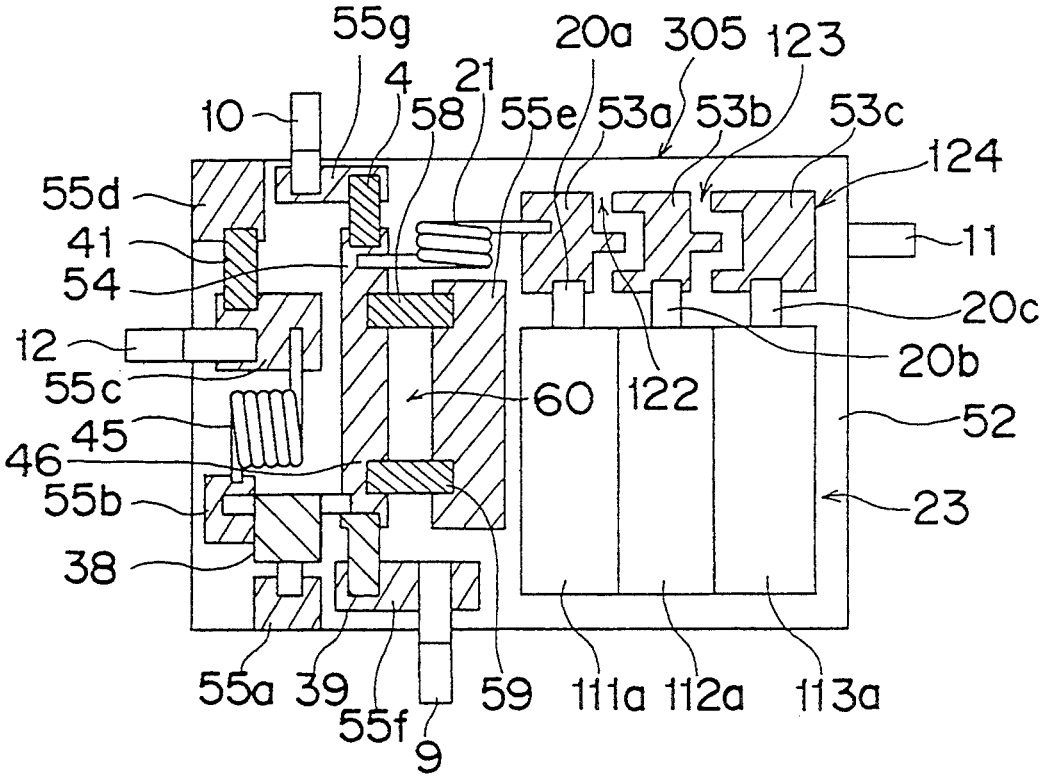
FIG. 5*a* is a top plan view of an antenna switching apparatus 305 of a fifth preferred embodiment according to the present invention.
Figure 5B:
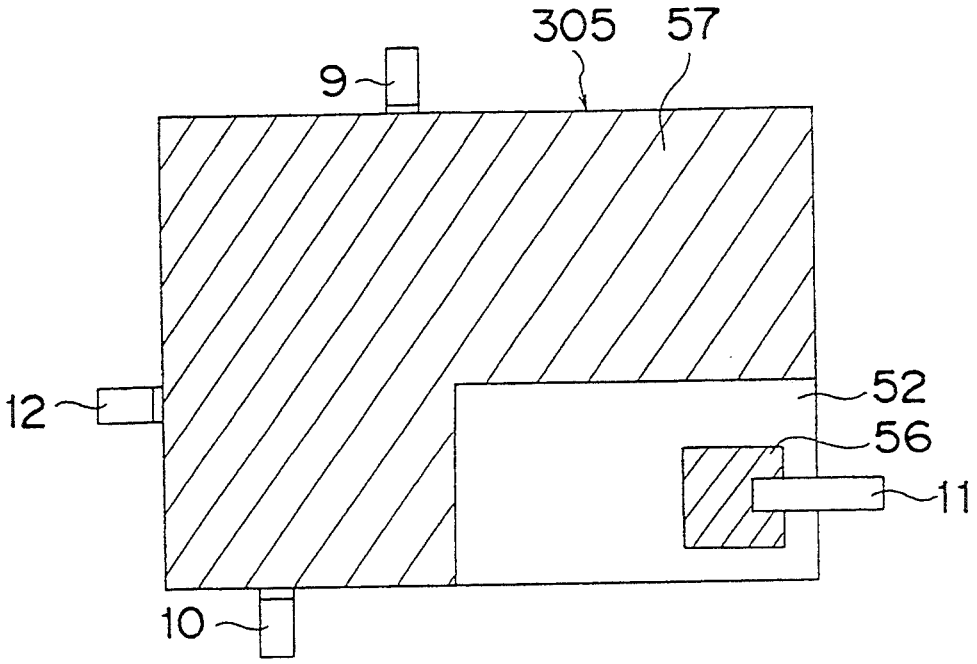
FIG. 5*b* is a bottom plan view of an antenna switching apparatus 305 shown in FIG. 5*a*.

FIG. 5*a* is a top plan view of an antenna switching apparatus 305 of a fifth preferred embodiment according to the present invention, and FIG. 5*b* is a bottom plan view of an antenna switching apparatus 305 shown in FIG. 5*a*. In FIGS. 5*a* and 5*b*, the same components as those shown in FIGS. 1*a*, 1*b*, 2*a*, 2*b*, 2*c*, 3*a*, 3*b*, 4*a* to 4*e* and 8 are denoted by the same reference numerals as those shown in FIGS. 1*a*, 1*b*, 2*a*, 2*b*, 2*c*, 3*a*, 3*b* 4*a* to 4*e* and 8.

Referring to FIG. 5*a*, electrically conductive electrode patterns 53*a* to 53*c*, 54 and 55*a* to 55*g* are formed on a top surface of a dielectric substrate 52. On the other hand, an a grounded electrically conductive electrode pattern 57 is formed on a part of the bottom surface of the dielectric substrate 52, and further, an electrically conductive electrode pattern 56 is formed on another part of the bottom surface of the dielectric substrate 34. The components 39, 46, 41, 45, 38, 4, 21 and 23 are electrically connected to the terminals 9 to 12, in a manner similar to that of the first modification of the fourth preferred embodiment shown in FIG. 4*c*.

Figure 5C:
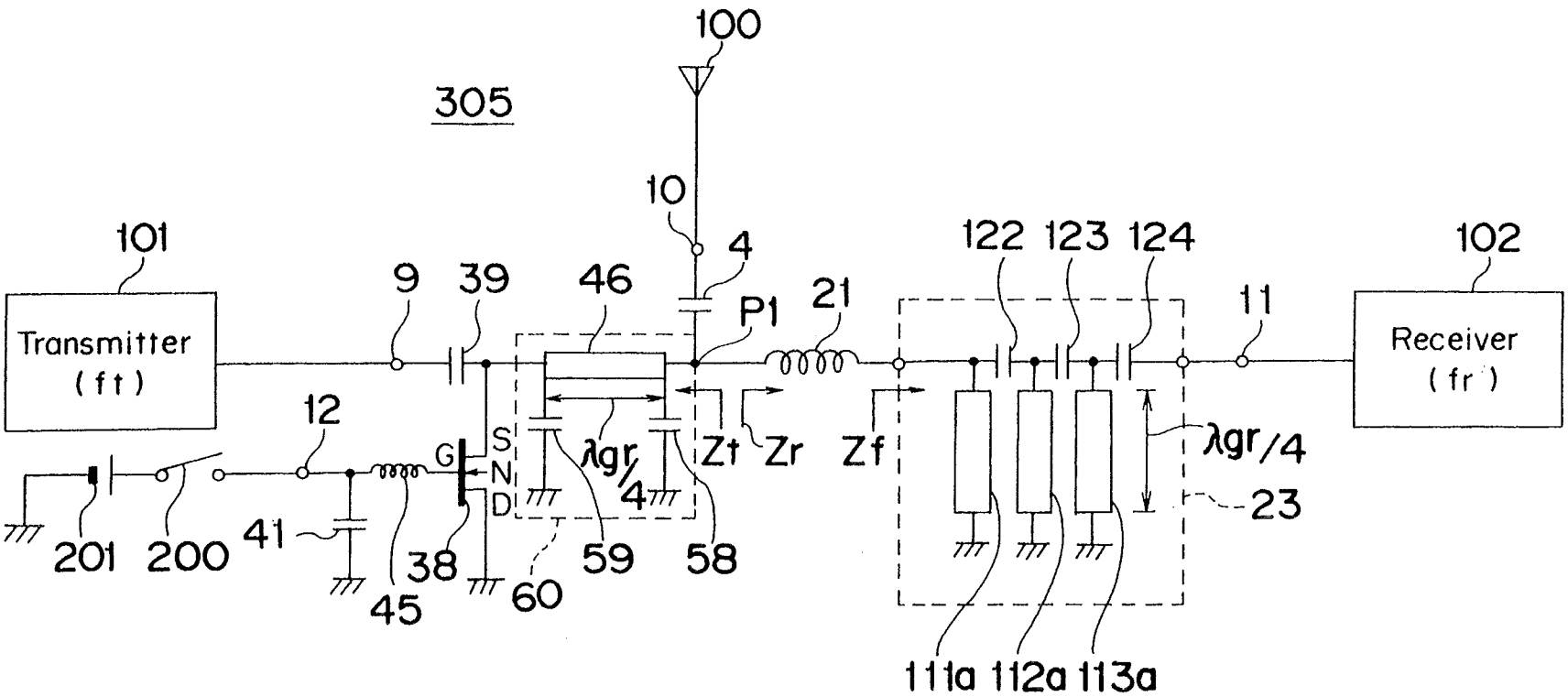
FIG. 5*c* is a circuit diagram of the antenna switching apparatus 305 shown in FIGS. 5*a* and 5*b*.

FIG. 5*c* is a circuit diagram of the antenna switching apparatus 305 shown in FIGS. 5*a* and 5*b*. As is apparent from comparison between the fifth preferred embodiment and the first modification of the fourth preferred embodiment respectively shown in FIGS. 4*c* and 5*c*, two capacitors 58 and 59 are further provided, respectively, at both ends of the microstrip line 46 of the electrode pattern 54 having a length of λgr/4 where λgr is the guide wavelength of the receiving frequency fr. This results in the microstrip line 46 and the two capacitors 58 and 59 constituting a low-pass filter 60, wherein a cut-off frequency of the low-pass filter 60 is set to a frequency equal to a value obtained by adding the transmitting frequency ft to a predetermined margin frequency.

The operation of the antenna switching apparatus 305 will be described in detail hereinafter with reference to FIG. 5*c*.

First of all, when the switch 200 is turned on, namely, when a positive direct-current bias voltage is supplied to the bias terminal 12, the FET 38 is turned on, and the impedance between the source and drain electrodes of the FET 38 becomes substantially zero, and the one end of the microstrip line 46 on the side of the capacitor 39 is electrically connected through the FET 38 of a short-circuit to ground. The phase at another end of the microstrip line 46 is shifted by λgr/4 by the microstrip line 46 and thereafter is electrically connected to ground. Therefore, the impedance Zt when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr to the receiving terminal 11.

On the other hand, when the switch 200 is turned off, namely, when the positive direct-current bias voltage is not supplied from the battery 201 through the switch 200 to the bias terminal 12, the FET 38 is turned off, and the impedance between the source and drain electrodes of the FET 38 becomes substantially infinity. Further, as described above, since the air-core inductor 21 is electrically connected as an input coupling component to the connection point P1, the impedance Zr when seen from the connection point P1 or the antenna terminal 10 looking toward the receiving band-pass filter 23 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the FET 38 is turned off.

The antenna switching apparatus 305 according to the fifth preferred embodiment has the effects similar to those of the fourth preferred embodiment. Further, since the low-pass filter 60 is provided between the connection point P1 and the capacitor 39, unnecessary high-order higher harmonics in the transmitting signal can be sufficiently suppressed.

In the fifth preferred embodiment, the microstrip line 46 is used; however, the present invention is not limited to this. A transmission line such as a strip line, a coplanar line or the like may be used instead of the microstrip line 46.

SIXTH PREFERRED EMBODIMENT

Figure 6:
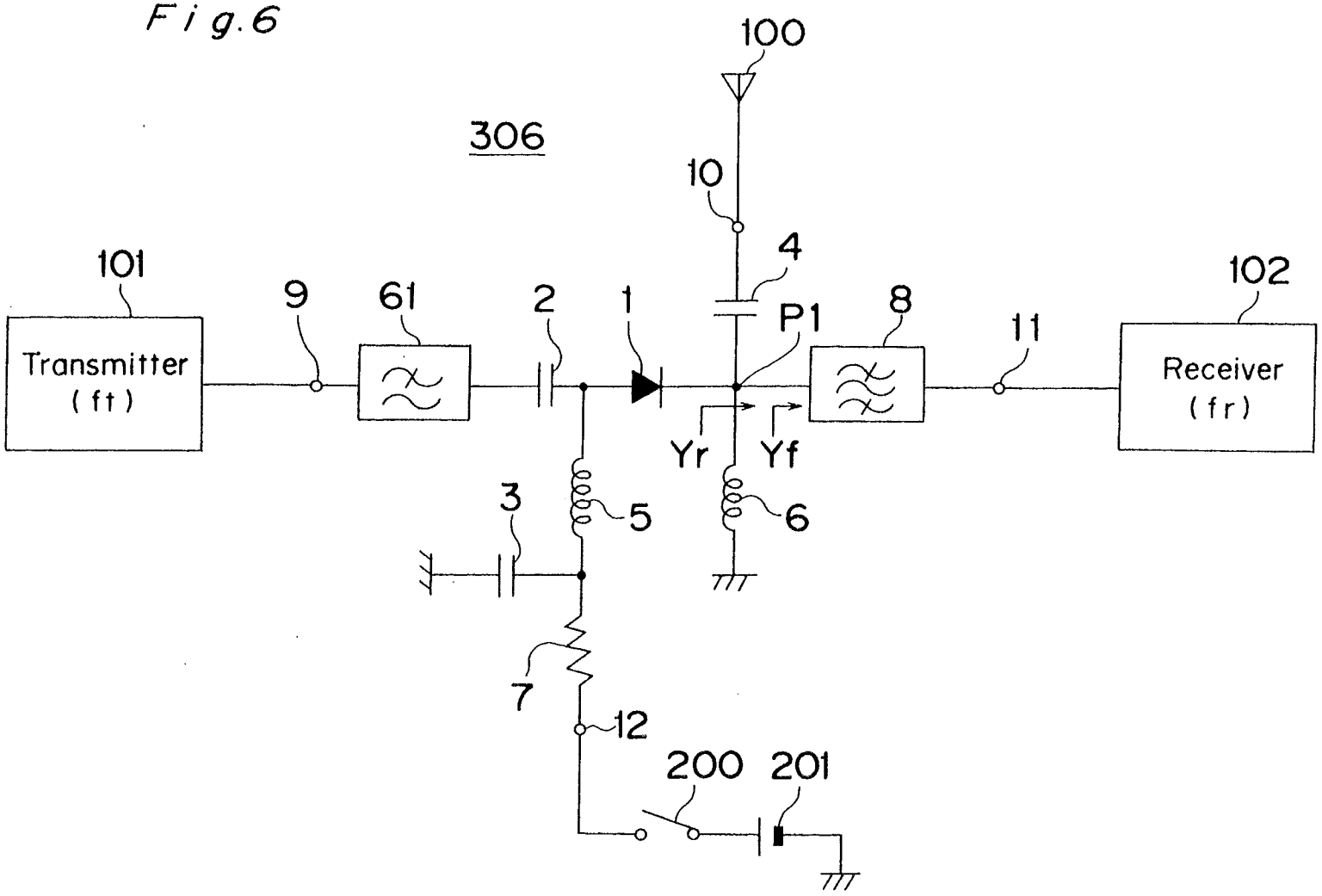
FIG. 6 is a circuit diagram of an antenna switching apparatus 306 of a sixth preferred embodiment according to the present invention.

FIG. 6 is a circuit diagram of an antenna switching apparatus 306 of a sixth preferred embodiment according to the present invention. In FIG. 6, the same components as those shown in FIGS. 1*a*, 1*b*, 2*a*, 2*b*, 2*c*, 3*a*, 3*b*, 4*a* to 4*e*, 5*a*, 5*b*, 5*c* and 8 are denoted by the same reference numerals as those shown in FIGS. 1*a*, 1*b*, 2*a*, 2*b*, 2*c*, 3*a*, 3*b*, 4*a* to 4*e*, 5*a*, 5*b*, 5*c* and 8.

As is apparent from comparison between FIGS. 1*b* and 6, the antenna switching apparatus 306 is characterized in further comprising a low-pass filter 61 in addition to the composition of the antenna switching apparatus 301 of the first preferred embodiment shown in FIG. 1*b*, wherein a cut-off frequency of the low-pass filter 61 is set to a frequency equal to a value obtained by adding the transmitting frequency ft to a predetermined margin frequency.

The antenna switching apparatus 306 operates in a manner similar to that of the antenna switching apparatus 301 of the first preferred embodiment; however, since the low-pass filter 61 is further provided between the connection point P1 and the transmitting terminal 9, unnecessary high-order higher harmonics in the transmitting signal can be sufficiently suppressed.

SEVENTH PREFERRED EMBODIMENT

Figure 7A:
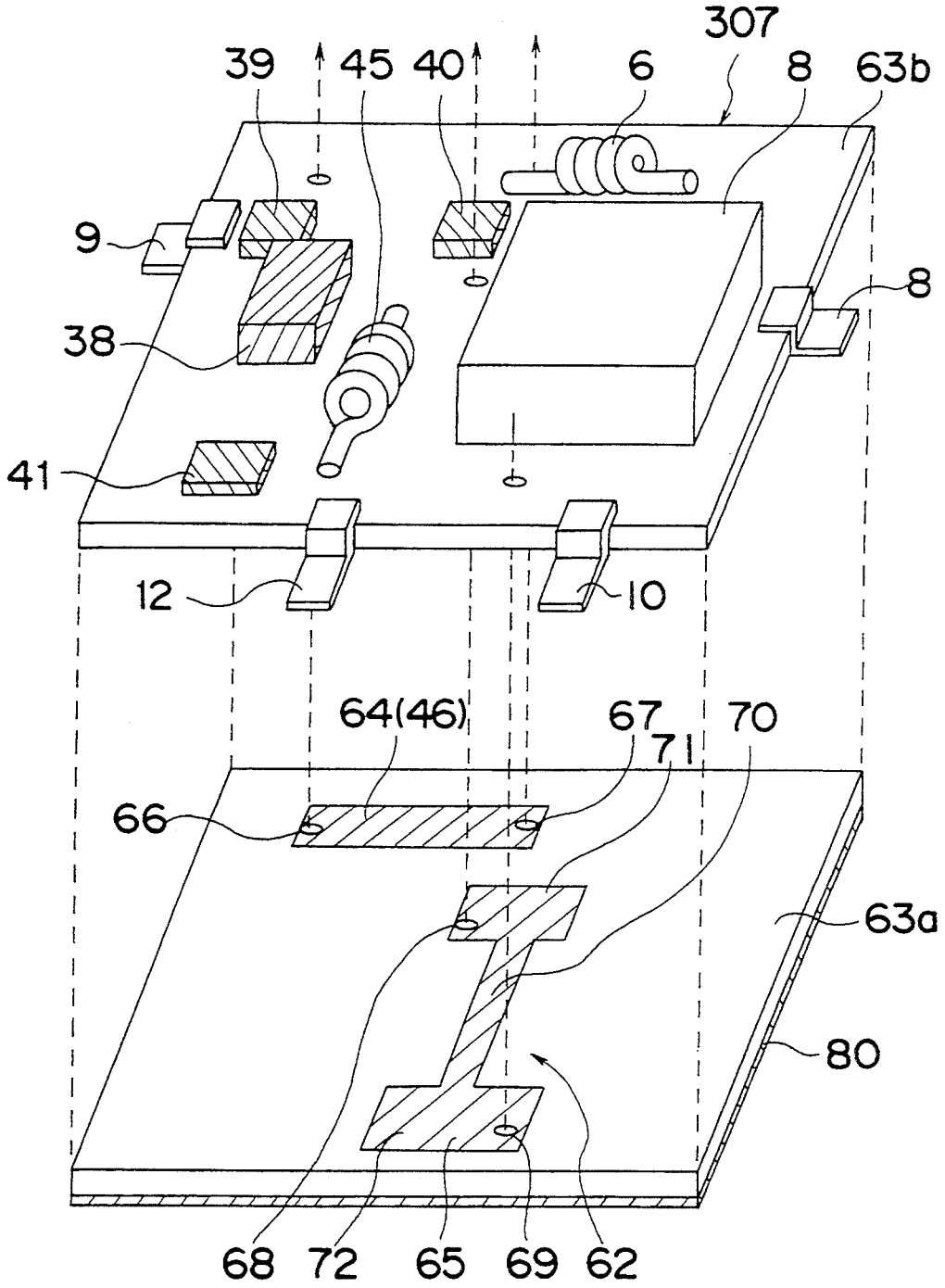
FIG. 7*a* is a perspective view of an antenna switching apparatus 307 of a seventh preferred embodiment according to the present invention.
Figure 7B:
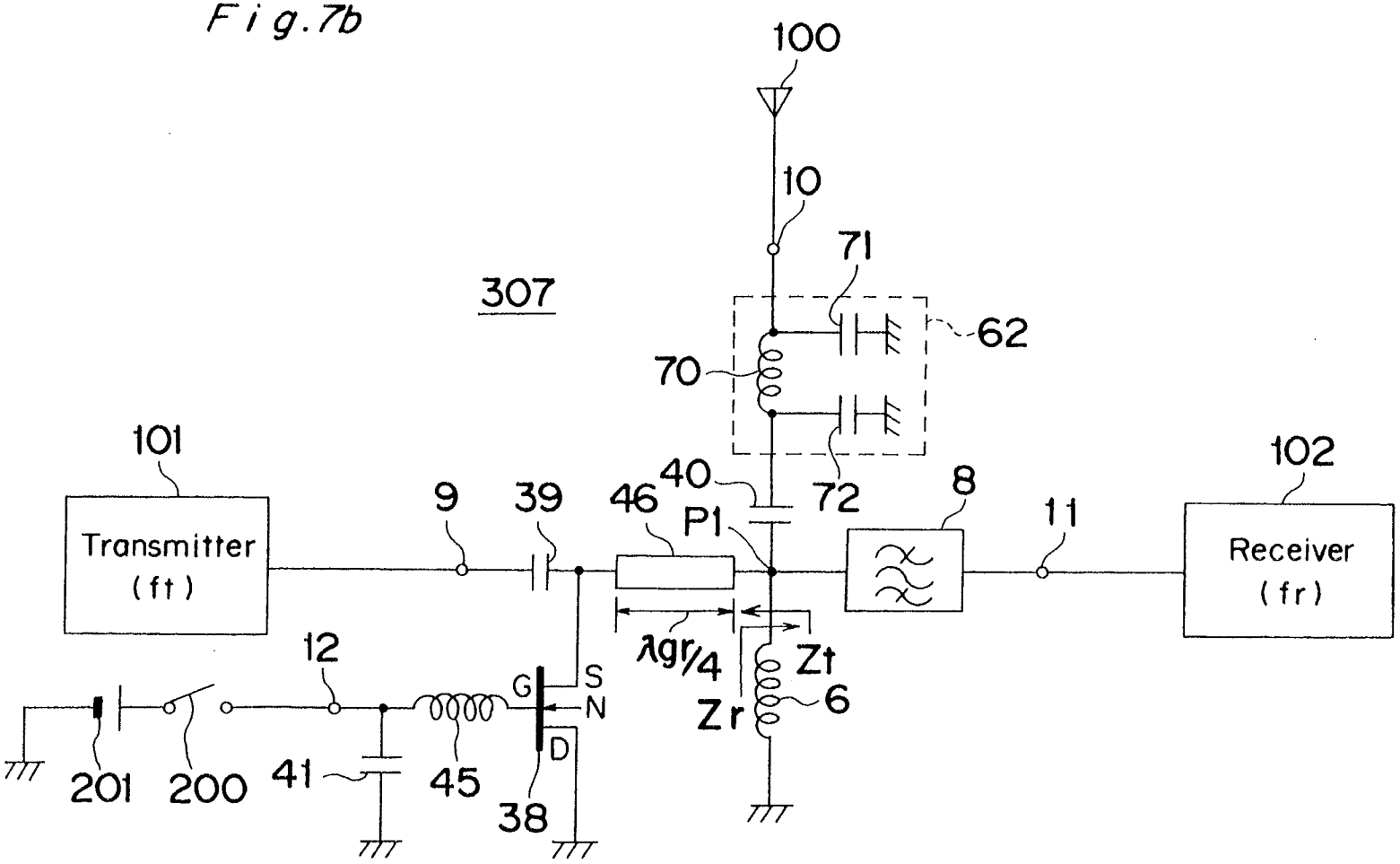
FIG. 7*b* is a circuit diagram of the antenna switching apparatus 307 shown in FIG. 7*a*.

FIG. 7*a* is a perspective view of an antenna switching apparatus 307 of a seventh preferred embodiment according to the present invention, and FIG. 7*b* is a circuit diagram of the antenna switching apparatus 307 shown in FIG. 7*a*. In FIGS. 7*a* and 7*b*, the same components as those shown in FIGS. 1*a*, 1*b*, 2*a*, 2*b*, 2*c*, 3*a*, 3*b*, 4*a* to 4*e*, 5*a*, 5*b*, 5*c*, 6 and 8 are denoted by the same reference numerals as those shown in FIGS. 1*a*, 1*b*, 2*a*, 2*b*, 2*c*, 3*a*, 3*b* 4*a* to 4*e*, 5*a*, 5*b*, 5*c*, 6 and 8.

As is apparent from a comparison between the fourth preferred embodiment shown in FIGS. 4*a* and 4*b* and the seventh preferred embodiment shown in FIGS. 7*a* and 7*b*, the antenna switching apparatus 307 has the following features:

(a) the microstrip line 32 is not provided;

(b) a capacitor 40 is provided instead of the capacitor 4; and (c) a low-pass filter 62 is further electrically connected between the antenna terminal 10 and the capacitor 40, the low-pass filter 62 comprising an inductor 70 and two capacitors 71 and 72 connected to both ends of the inductor 70, wherein the low-pass filter 62 has a cut-off frequency fc equal to a value obtained by adding the higher of the transmitting and receiving frequencies ft and fr to a predetermined margin frequency in a manner similar to that of the low-pass filter 33 of the third preferred embodiment.

The antenna switching apparatus 307 further has the following features. Two laminated dielectric top and bottom substrates 63*a* and 63*b*are provided. Electrically conductive electrode patterns (not shown) are formed on a bottom surface of the top substrate 63*b*. Electrically conductive electrode patterns 64 and 65 are formed on a top surface of the bottom substrate 63*a*, wherein the electrode pattern 64 constitutes a microstrip line 46, and also the electrode pattern 65 forms two electrodes for use in the two capacitors 71 and 72 and the microstrip line for use in the inductor 70. Further, an electrically conductive grounded electrode pattern 80 is formed on the entire area of the bottom surface of the bottom substrate 63*a*. In other words, the antenna switching apparatus 307 is characterized in comprising the electrode patterns 64 and 65 formed on the inner layer of the laminated substrates 63*a* and 63*b*.

An action of the antenna switching apparatus 307 will be described in detail hereinafter with reference to FIG. 7*b*.

First of all, when the switch 200 is turned on, namely, when a positive direct-current bias voltage is supplied to the bias terminal 12, the FET 38 is turned on, and the impedance between the source and drain electrodes of the FET 38 becomes substantially zero, and then the one end of the microstrip line 46 on the side of the capacitor 39 is electrically connected through the FET 38 to a short-circuit to ground. The phase at another end of the microstrip line 46 is shifted by λgr/4 by the microstrip line 46, and thereafter is electrically connected to ground. Therefore, the impedance Zt when seen from the antenna terminal 10 looking toward the transmitting terminal 9 becomes substantially infinity, and the transmitting terminal 9 is electrically separated from the antenna terminal 10 while the antenna terminal 10 is electrically connected at the receiving frequency fr to the receiving terminal 11.

On the other hand, when the switch 200 is turned off, namely, when the positive direct-current bias voltage is not supplied from the battery 201 through the switch 200 to the bias terminal 12, the FET 38 is turned off, and then the impedance between the source and drain electrodes of the FET 38 becomes substantially infinity. Further, as described above, since the air-core inductor 6 is electrically connected to the connection point P1, the impedance Zr when seen from the connection point P1 looking toward the receiving band-pass filter 8 becomes substantially infinity at the transmitting frequency ft. Therefore, the receiving terminal 11 is electrically separated at the transmitting frequency ft from the antenna terminal 10 while the transmitting terminal 9 is electrically connected to the antenna terminal 10 since the FET 38 is turned off.

The antenna switching apparatus 307 according to the seventh preferred embodiment has the effects similar to those of the first and fourth preferred embodiments. Further, since the low-pass filter 62 is further provided between the antenna terminal 10 and the capacitor 40, high-order higher harmonics in both the transmitting and receiving signals can be sufficiently suppressed. Furthermore, since the microstrip line 46 and the low-pass filter 62 are formed by the electrode patterns 65 and 66 on the inner layer of the laminated dielectric substrates 63*a* and 63*b*, the dimensions of the circuit of the antenna switching apparatus 307 can be reduced, resulting in a smaller-sized antenna switching apparatus 307.

OTHER PREFERRED EMBODIMENTS

In the above-mentioned preferred embodiments, the plane type dielectric receiving band-pass filter 8 and the dielectric coaxial receiving band-pass filter 23 are used however, the present invention is not limited to this. For example, either (a) various kinds of band-pass filters may be used for passing therethrough the receiving signal having the receiving frequency fr but preventing the transmitting signal from passing therethrough or (b) various kinds of band-stop filters may be used for stopping the transmitting signal from passing therethrough, such as a SAW (Surface Acoustic Wave) filter. or the like.

In the above-mentioned first and second preferred embodiments shown in FIGS. 1*a*, 1*b*, 2*a*, 2*b*, and 2*c*, the receiving frequency fr may be higher than the transmitting frequency ft.

In the above-mentioned fourth preferred embodiment, the first modification thereof, the fifth and seventh preferred embodiments, the FET 38 is used as a switching device. However, the present invention is not limited to this. A PIN diode may be used instead of the FET 38.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

What is claimed is:

1. An antenna switching apparatus for selectively connecting an antenna to either a transmitter for transmitting a transmitting signal having a transmitting frequency, or to a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing only a receiving signal therethrough and for preventing a transmitting signal from passing therethrough;

a bi-directional impedance adjusting element electrically connected to an input end of said receiving filter, said impedance adjusting element having an element value such that an impedance when seen from said antenna terminal looking toward said receiving filter becomes substantially infinity at said transmitting frequency; and a switching device electrically connected between said antenna terminal and said transmitting terminal, said switching device being turned on or off in response to a control signal;

wherein said impedance adjusting element is an inductor electrically connected between the input end of said receiving filter and ground.

2. An antenna switching apparatus for selectively connecting an antenna to either a transmitter for transmitting a transmitting signal having a transmitting frequency, or to a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing only a receiving signal therethrough and for preventing a transmitting signal from passing therethrough;

a bi-directional impedance adjusting element electrically connected to an input end of said receiving filter, said impedance adjusting element having an element value such that an impedance when seen from said antenna terminal looking toward said receiving filter becomes substantially infinity at said transmitting frequency; and a switching device electrically connected between said antenna terminal and said transmitting terminal, said switching device being turned on or off in response to a control signal;

wherein said impedance adjusting element is a transmission line connected between the input end of said receiving filter and said antenna terminal, said transmission line having a length such that an impedance when seen from said antenna terminal looking toward said receiving filter becomes substantially infinity at said transmitting frequency.

3. An antenna switching apparatus for selectively connecting an antenna to either a transmitter for transmitting a transmitting signal having a transmitting frequency, or to a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing only a receiving signal therethrough and for preventing a transmitting signal from passing therethrough;

a bi-directional impedance adjusting element electrically connected to an input end of said receiving filter, said impedance adjusting element having an element value such that an impedance when seen from said antenna terminal looking toward said receiving filter becomes substantially infinity at said transmitting frequency; and a switching device electrically connected between said antenna terminal and said transmitting terminal, said switching device being turned on or off in response to a control signal;

further comprising a low-pass filter electrically connected between said antenna terminal and said receiving filter, said low-pass filter having a cut-off frequency equal to a value obtained by adding the higher of said transmitting and receiving frequencies to a predetermined margin frequency.

4. An antenna switching apparatus for selectively connecting an antenna to either a transmitter for transmitting a transmitting signal having a transmitting frequency, or to a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing only a receiving signal therethrough and for preventing a transmitting signal from passing therethrough;

a bi-directional impedance adjusting element electrically connected to an input end of said receiving filter, said impedance adjusting element having an element value such that an impedance when seen from said antenna terminal looking toward said receiving filter becomes substantially infinity at said transmitting frequency; and a switching device electrically connected between said antenna terminal and said transmitting terminal, said switching device being turned on or off in response to a control signal;

further comprising a low-pass filter electrically connected between said antenna terminal and said switching device, said low-pass filter having a cut-off frequency equal to a value obtained by adding said transmitting frequency to a predetermined margin frequency.

5. An antenna switching apparatus for selectively connecting an antenna to either a transmitter for transmitting a transmitting signal having a transmitting frequency, or to a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing only a receiving signal therethrough and for preventing a transmitting signal from passing therethrough;

a bi-directional impedance adjusting element electrically connected to an input end of said receiving filter, said impedance adjusting element having an element value such that an impedance when seen from said antenna terminal looking toward said receiving filter becomes substantially infinity at said transmitting frequency; and a switching device electrically connected between said antenna terminal and said transmitting terminal, said switching device being turned on or off in response to a control signal;

further comprising a low-pass filter electrically connected between said transmitting terminal and said switching device, said low-pass filter having a cut-off frequency equal to a value obtained by adding said transmitting frequency to a predetermined margin frequency.

6. An antenna switching apparatus for selectively connecting an antenna to either a transmitter for transmitting a transmitting signal having a transmitting frequency, or a receiver for receiving a receiving signal having a receiving frequency which is different from said transmitting frequency, comprising:

an antenna terminal electrically connected to said antenna;

a transmitting terminal electrically connected to said transmitter;

a receiving terminal electrically connected to said receiver;

a receiving filter, electrically connected between said antenna terminal and said receiving terminal, for passing a receiving signal therethrough;

an impedance adjusting element electrically connected to an input end of said receiving filter, said impedance adjusting element having an element value such that an impedance when seen from said antenna terminal looking toward said receiving filter becomes substantially infinity at said transmitting frequency;

a transmission line electrically connected between said antenna terminal and said transmitting terminal, said transmission line having a length equal to one quarter of the guide wavelength of the receiving frequency; and a switching device electrically connected between said transmitting terminal and ground, said switching device being turned on or off in response to a control signal, thereby switching over so that an impedance when seen from said antenna terminal looking toward said transmitting terminal becomes either substantially infinity or substantially zero, respectively.

7. The antenna switching apparatus as claimed in claim 6, wherein said impedance adjusting element is an inductor electrically connected between the input end of said receiving filter and ground.

8. The antenna switching apparatus as claimed in claim 6, wherein said impedance adjusting element is an inductor electrically connected between the input end of said receiving filter and said antenna terminal.

9. The antenna switching apparatus as claimed in claim 6, wherein said impedance adjusting element is a further transmission line connected between the input end of said receiving filter and said antenna terminal, said further transmission line having a length such that an impedance when seen from said antenna terminal looking toward said receiving filter becomes substantially infinity at said transmitting frequency.

10. The antenna switching apparatus as claimed in claim 6, further comprising a low-pass filter electrically connected between said antenna terminal and said receiving filter, said low-pass filter having a cut-off frequency equal to a value obtained by adding the higher of said transmitting and receiving frequencies to a predetermined margin frequency.

11. The antenna switching apparatus as claimed in claim 6, further comprising a low-pass filter electrically connected between said antenna terminal and said switching device, said low-pass filter having a cut-off frequency equal to a value obtained by adding said transmitting frequency to a predetermined margin frequency.

12. The antenna switching apparatus as claimed in claim 6, further comprising a low-pass filter electrically connected between said transmitting terminal and said switching device, said low-pass filter having a cut-off frequency equal to a value obtained by adding said transmitting frequency to a predetermined margin frequency.

13. The antenna switching apparatus as claimed in claim 6, wherein said switching device is a PIN diode.

14. The antenna switching apparatus as claimed in claim 6, wherein said switching device is a field effect transistor.

15. An antenna switching apparatus for selectively connecting an antenna to a transmitter for transmitting a transmitting signal having a transmitting frequency in response to a control signal, and for continuously connecting an antenna to a receiver for receiving a receiving signal having a receiving frequency which is different from said transmitting frequency, the antenna switching apparatus comprising:

an antenna terminal electrically connected to said antenna;

a transmitting terminal electrically connected to said transmitter;

a receiving terminal electrically connected to said receiver;

a switching device electrically connected between said antenna terminal and said transmitting terminal, said switching device being turned on or off in response to said control signal;

a receiving filter, electrically connected between said antenna terminal and said receiving terminal, for preventing said transmitting signal from passing therethrough, said receiving signal being always transmitted from said antenna terminal to said receiving terminal through said receiving filter regardless of a condition of said control signal; and a bi-directional impedance adjusting element electrically connected to an input end of said receiving filter, said impedance adjusting element having an element value such that an impedance when seen from said antenna terminal looking toward said receiving filter becomes substantially infinity at said transmitting frequency.

16. The antenna switching apparatus as claimed in claim 15, wherein said impedance adjusting element is an inductor electrically connected between the input end of said receiving filter and said antenna terminal.

17. The antenna switching apparatus as claimed in claim 15, wherein said switching device is a PIN diode.

18. The antenna switching apparatus as claimed in claim 15, wherein said switching device is a field effect transistor.

19. The antenna switching apparatus as claimed in claim 15, wherein said receiving filter is a band-pass filter.

20. The antenna switching apparatus as claimed in claim 15, wherein said receiving filter is a band-stop filter.

21. The antenna switching apparatus as claimed in claim 15, wherein said receiving filter is a dielectric coaxial-type filer.

22. The antenna switching apparatus as claimed in claim 15, wherein said receiving filter is a dielectric stripline-type filter.

23. The antenna switching apparatus as claimed in claim 15, wherein said receiving filter is a SAW filter.

24. The antenna switching apparatus as claimed in claim 15, wherein said receiving filter is a multi-stage filter.

25. An antenna switching apparatus for selectively connecting an antenna to either a transmitter for transmitting a transmitting signal having a transmitting frequency, or to a receiver for receiving a receiving signal having a receiving frequency which is higher than said transmitting frequency, the antenna switching apparatus comprising:

an antenna terminal electrically connected to said antenna;

a transmitting terminal electrically connected to said transmitter;

a receiving terminal electrically connected to said receiver;

a receiving band-pass filter, electrically connected between said antenna terminal and said receiving terminal, for passing only said receiving signal therethrough and for preventing said transmitting signal from passing therethrough;

a bi-directional impedance adjusting element electrically connected to an input end of said receiving band-pass filter, said impedance adjusting element having an element value such that an impedance when seen from said antenna terminal looking toward said receiving band-pass filter becomes substantially infinity at said transmitting frequency; and a switching device electrically connected between said antenna terminal and said transmitting terminal, said switching device being turned on or off in response to a control signal.

* * * * *